US007798252B2

(12) United States Patent
Barbera

(10) Patent No.: US 7,798,252 B2
(45) Date of Patent: Sep. 21, 2010

(54) METHOD AND APPARATUS FOR PROVIDING A CONTINUOUS STROKE AUGER BORING MACHINE

(76) Inventor: James S. Barbera, 1635 37th St. NW., Canton, OH (US) 44709

( * ) Notice: Subject to any disclaimer, the term of this patent is extended or adjusted under 35 U.S.C. 154(b) by 241 days.

(21) Appl. No.: 11/715,022

(22) Filed: Mar. 7, 2007

(65) Prior Publication Data

US 2008/0217070 A1 Sep. 11, 2008

(51) Int. Cl.
*E21B 17/18* (2006.01)

(52) U.S. Cl. ..... 175/325.2; 175/62

(58) Field of Classification Search ..... 175/62, 175/122, 162, 203
See application file for complete search history.

(56) References Cited

U.S. PATENT DOCUMENTS

| | | | | | |
|---|---|---|---|---|---|
| 1,932,068 | A | | 10/1933 | Englebright et al. | |
| 2,338,351 | A | | 1/1944 | Parrish | |
| 3,162,254 | A | | 12/1964 | Rose | |
| 3,612,194 | A | * | 10/1971 | Richmond | 175/92 |
| 4,024,721 | A | | 5/1977 | Takada et al. | |
| 4,117,895 | A | | 10/1978 | Ward et al. | |
| 4,387,775 | A | | 6/1983 | Adolfsson et al. | |
| 4,630,967 | A | * | 12/1986 | Soltau | 405/184 |
| 4,684,290 | A | * | 8/1987 | Soltau | 405/184 |
| 4,977,967 | A | * | 12/1990 | Alston et al. | 175/45 |
| 5,314,267 | A | | 5/1994 | Osadchuk | |
| 5,431,234 | A | * | 7/1995 | Klemm | 173/184 |
| 5,711,385 | A | * | 1/1998 | Brotherton | 175/257 |
| 5,941,320 | A | * | 8/1999 | Austin et al. | 175/27 |
| 6,206,109 | B1 | * | 3/2001 | Monier et al. | 175/53 |
| 6,279,667 | B1 | * | 8/2001 | Culver | 175/19 |
| 6,682,264 | B1 | | 1/2004 | McGillis | |
| 6,827,158 | B1 | | 12/2004 | Dimitroff et al. | |
| 6,953,306 | B2 | * | 10/2005 | McGillis | 405/184 |
| 7,614,461 | B2 | * | 11/2009 | Barbera | 175/62 |
| 2003/0070841 | A1 | * | 4/2003 | Merecka et al. | 175/19 |
| 2004/0035572 | A1 | | 2/2004 | Cooper | |
| 2005/0103527 | A1 | | 5/2005 | Church et al. | |
| 2008/0073123 | A1 | * | 3/2008 | Mullins et al. | 175/62 |

FOREIGN PATENT DOCUMENTS

| | | | |
|---|---|---|---|
| SU | 863831 | A1 | 9/1981 |

* cited by examiner

*Primary Examiner*—Kenneth Thompson
*Assistant Examiner*—James G Sayre
(74) *Attorney, Agent, or Firm*—Sand & Sebolt

(57) ABSTRACT

An auger boring machine provides a continuous stroke drive assembly for driving a pilot tube to form an underground pilot hole used for guiding an auger in boring an underground pipe installation hole. The drive assembly preferably drives the pilot tube a distance at least the length of one of the pilot tube segments making up the pilot tube to substantially expedite the process. One embodiment includes a hydraulic piston-cylinder combination with a cylinder at least the length of the pilot tube segment. Alternately, a rack and a pinion drive mechanism may be used with a rack at least the length of the pilot tube segment or even more than twice that length to allow for a pair of pilot tube segments to be added simultaneously to the pilot tube. A lubricant feed system allows water to be pumped through passages formed in the pilot tube and steering head.

29 Claims, 25 Drawing Sheets

| FIG-5A | FIG-5B | FIG-5C |
|---|---|---|

METHOD AND APPARATUS FOR PROVIDING A CONTINUOUS STROKE AUGER BORING MACHINE

BACKGROUND OF THE INVENTION

1. Technical Field

The invention relates generally to an auger boring machine and a method of use in the trenchless installation of underground pipe. More particularly, the invention relates to such a machine which utilizes a pilot tube for forming a pilot hole for guiding the auger of the machine. Specifically, the invention relates to a jacking or driving mechanism for driving the pilot tube into the earth via a continuous stroke.

2. Background Information

The use of an auger boring machine for installing underground pipe between two locations without digging a trench there between is broadly known. In addition, it is known to use a pilot tube formed of a plurality of pilot tube segments to create a pilot hole for guiding an auger which bores a larger hole so that the auger remains within a reasonably precise line and grade. For example, see U.S. Pat. No. 6,206,109 granted to Monier et al. Due to the enormous amount of force that must be applied to drive the pilot tube, the frame of the jacking mechanism must be very securely grounded to provide a stationary base for driving the pilot tube. The jacking mechanisms or drive mechanisms which are used to jack or drive the pilot tube through the soil are problematic in that they are configured to drive the tube in relatively small steps and require that the frame of the jacking mechanism be moved forward after jacking the pilot tube a certain distance in order to subsequently jack the pilot tube a further distance. The need to move the frame in particular substantially slows down the process. The present invention solves this and other problems in the art.

BRIEF SUMMARY OF THE INVENTION

The present invention provides a drive assembly for use with an auger boring machine pilot tube with at least one pilot tube segment having leading and trailing ends defining therebetween a first length; the drive assembly comprising: a frame; a pilot tube engaging member movably mounted on the frame and adapted to drivingly engage the pilot tube; and a drive mechanism for driving the engaging member a first distance equal to or greater than the first length while the frame is stationary.

The present invention further provides a method comprising the steps of: driving an auger boring machine pilot tube a distance equal to or greater than a length of a first pilot tube segment thereof with a pilot tube engaging member movably mounted on a frame while the frame is stationary to form in the earth a pilot hole adapted to be followed by an auger.

BRIEF DESCRIPTION OF THE SEVERAL VIEWS OF THE DRAWINGS

FIG. 14 also illustrates the flow of lubricant through the pilot tube to the steering head.

Similar numbers refer to similar parts throughout the drawings.

DETAILED DESCRIPTION OF THE INVENTION

Figure 1:
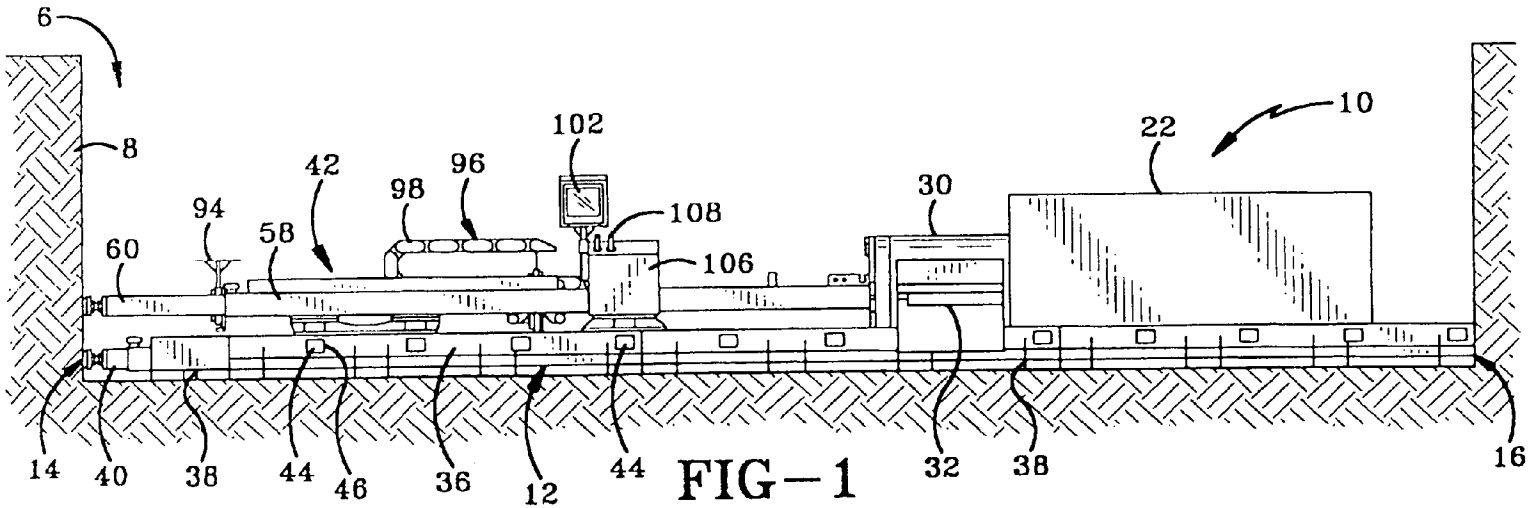
FIG. 1 is a side elevational view of a first embodiment of the auger boring machine of the present invention shown in a pit formed in the earth.
Figure 2:
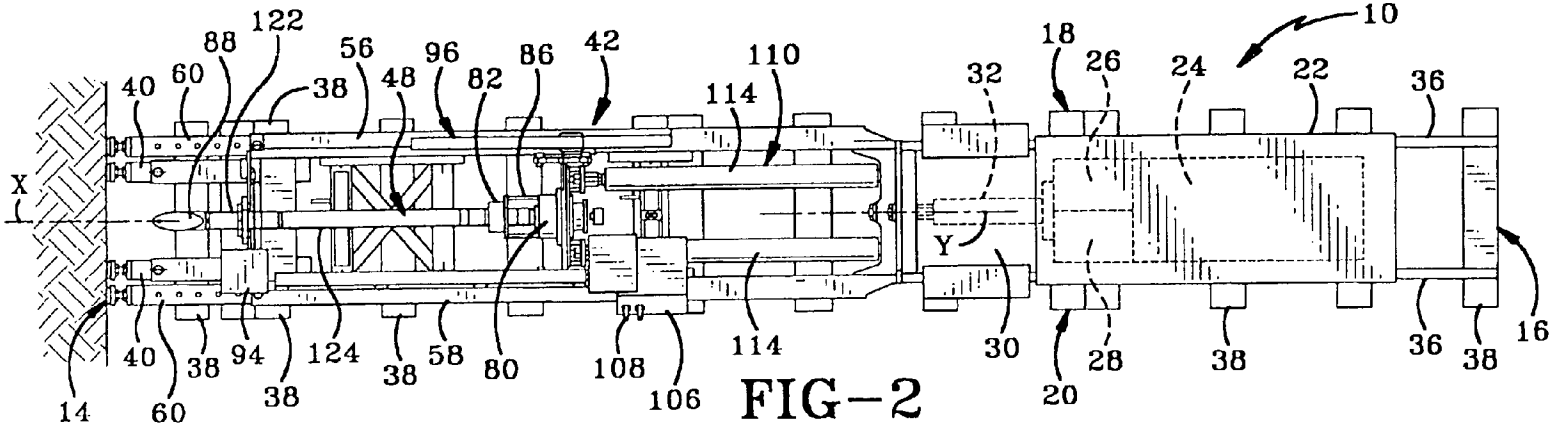
FIG. 2 is a top plan view of the first embodiment.
Figure 26:
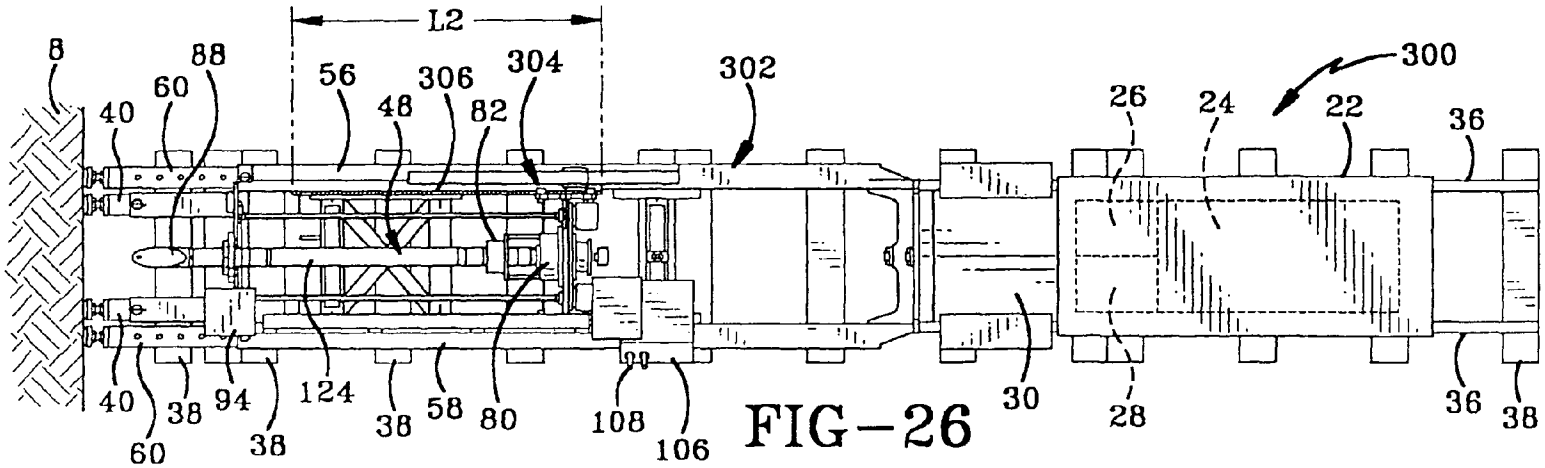
FIG. 26 is a top plan view of a second embodiment of the auger boring machine of the present invention showing the rack and pinion pilot tube drive mechanism.
Figure 27:
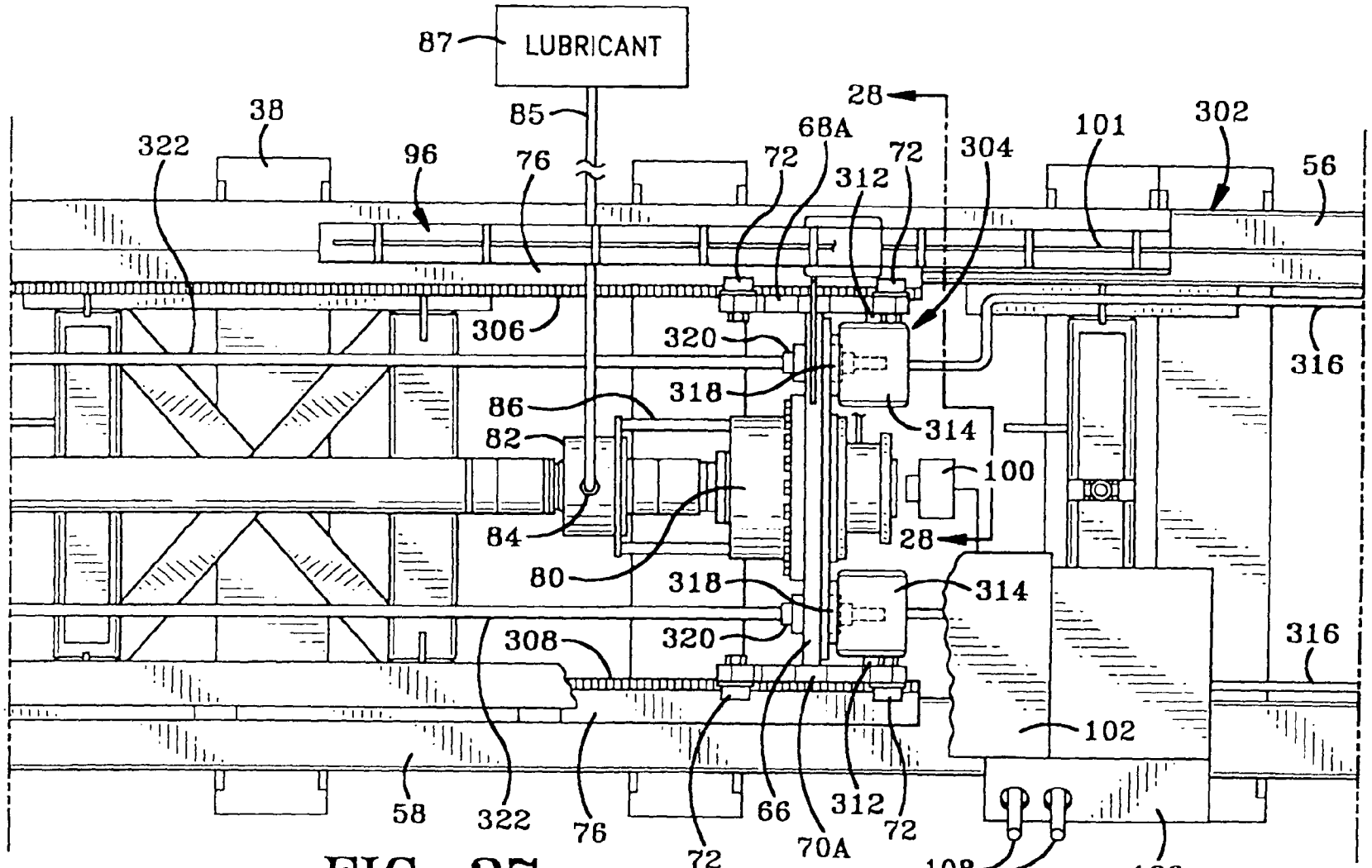
FIG. 27 is an enlarged top plan view of a portion of the rack and pinion drive mechanism.
Figure 32:
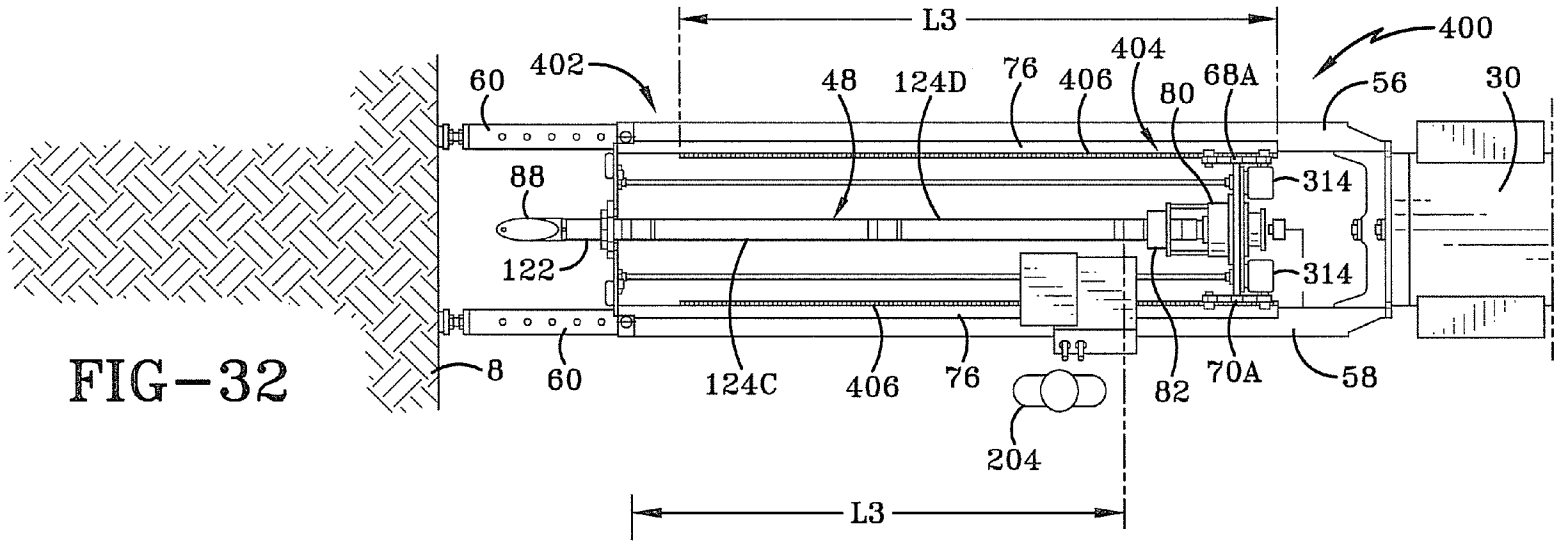
FIG. 32 is a top plan view of a third embodiment of the auger boring machine of the present invention in which the rack and pinion drive mechanism has a longer rack.
Figure 33:
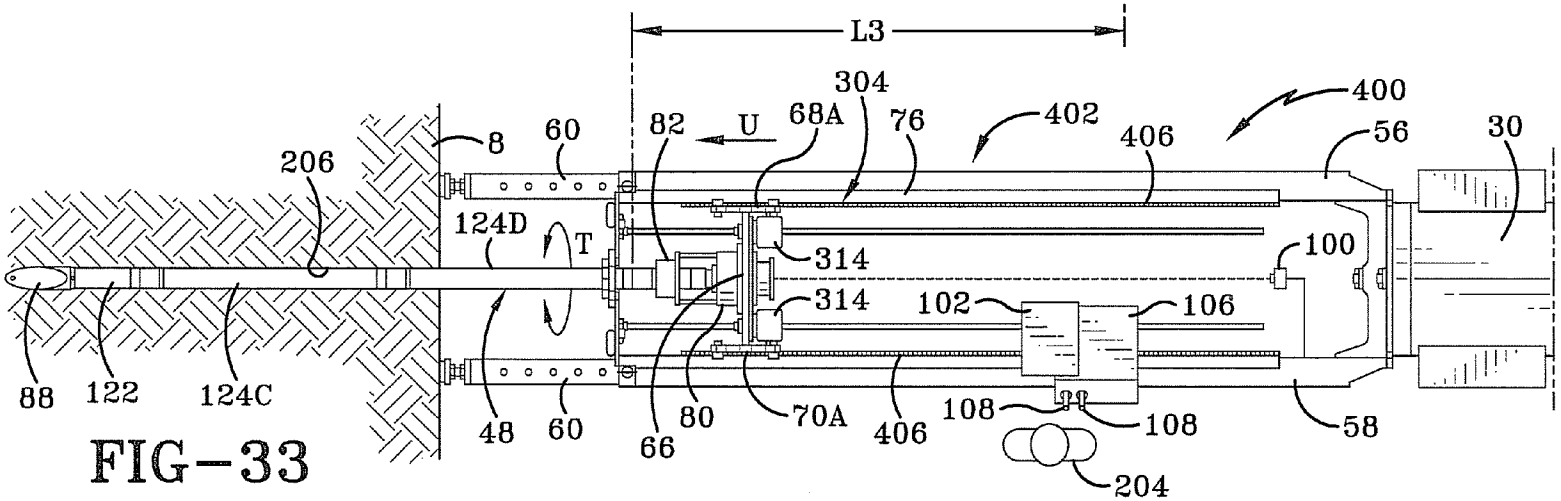
FIG. 33 is similar to FIG. 32 and shows the operation of the drive mechanism of the third embodiment in driving the pilot tube to form the pilot hole.

A first embodiment of the auger boring machine of the present invention is indicated generally at 10 in FIGS. 1 and 2; a second embodiment is indicated generally at 300 in FIG. 26; and a third embodiment is indicated generally at 400 in FIGS. 32-33. Referring to FIG. 1, machine 10 is typically disposed in a pit 6 formed in the earth's soil or ground 8 and configured to bore a hole through ground 8 for the purpose of laying underground pipe in the bored hole. Machine 10 typically bores a hole from within a pit such as pit 6 to another pit which may be spaced several hundred feet away. Machine 10 includes a frame 12 which extends from a front end 14 to a rear end 16 of machine 10. Front and rear end 14 and 16 define there between a longitudinal direction of machine 10. Machine 10 further has first and second opposed sides 18 and 20 (FIG. 2) defining there between an axial direction of machine 10.

Figure 25:
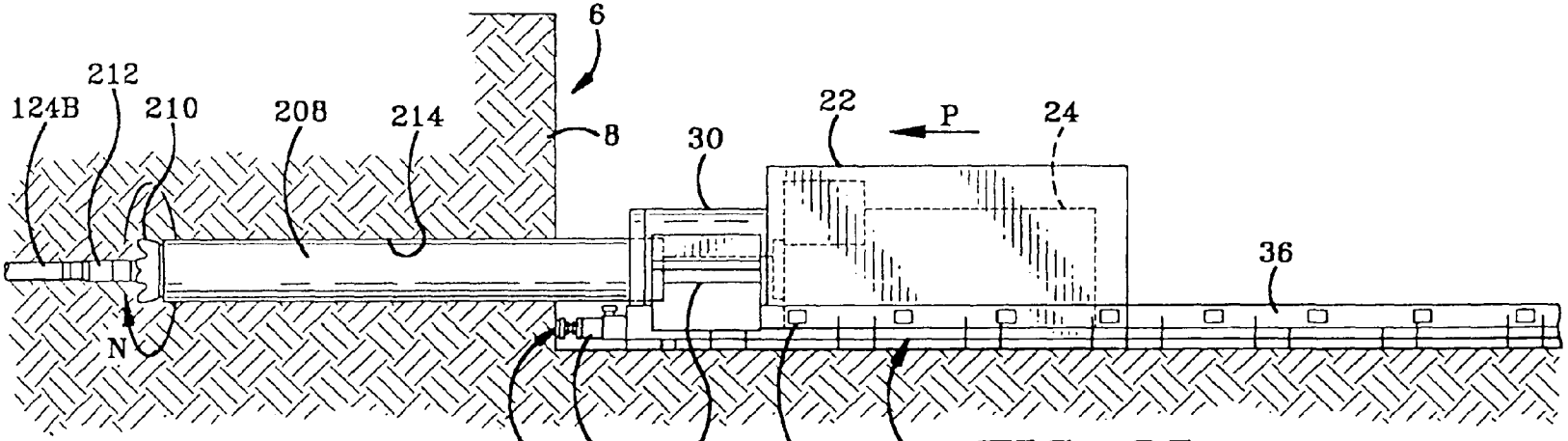
FIG. 25 is similar to FIG. 24 and shows the auger boring an enlarged diameter hole as it follows the pilot tube.

An engine compartment 22 is mounted on frame 12 and houses therein a fuel powered engine 24, an electric generator 26 powered by engine 24 and a hydraulic pump 28 also powered by engine 24. An auger drive compartment 30 is disposed in front of compartment 22 and houses therein an auger drive having a rotational output shaft 32 for rotationally driving an auger 34 (FIG. 25). Frame 12 further includes a pair of spaced longitudinally extending rails 36 secured to a plurality of cross bars 38 which are mounted on ground 8 in the bottom of pit 6. A pair of adjustable stabilizing poles 40 are telescopically received in and adjustably mounted respectively on rails 36 and configured to press against the wall of ground 8 which bounds pit 6.

Figure 3:
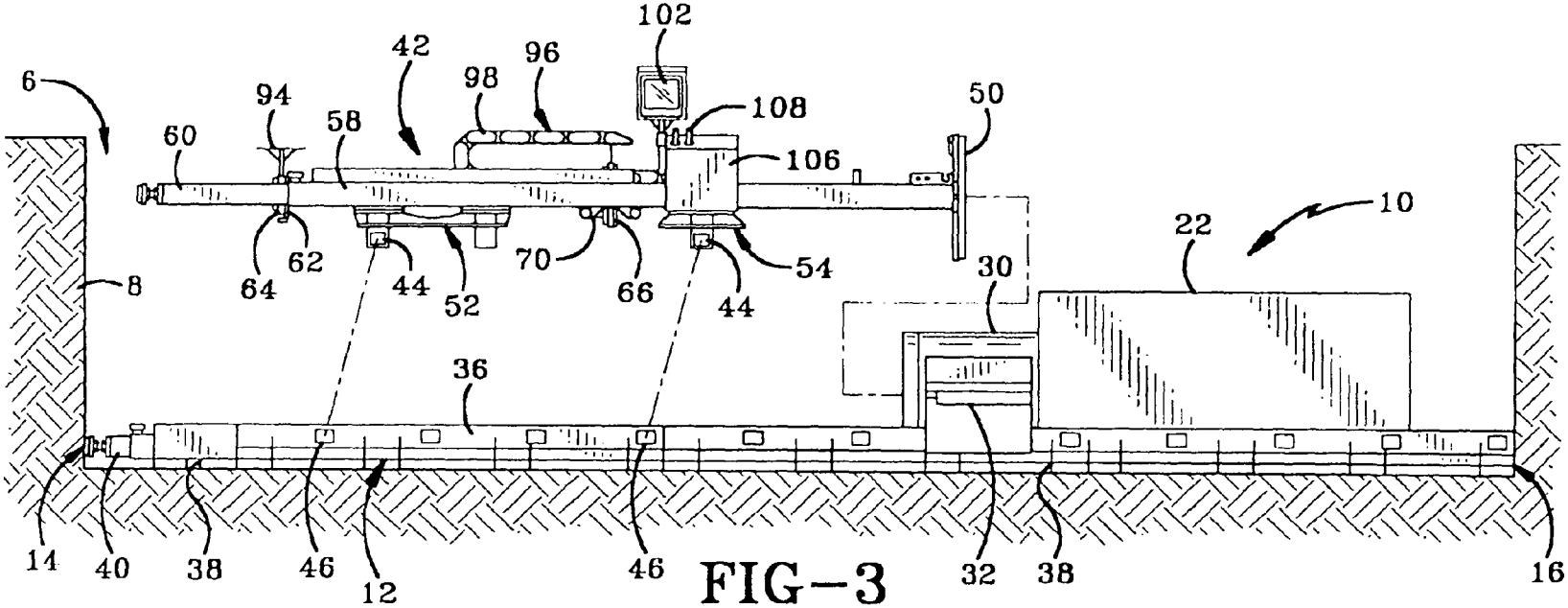
FIG. 3 is a side elevational view similar to FIG. 1 showing the pilot tube drive and control mechanism removed from the frame of the boring machine.

In accordance with a feature of the invention, a pilot tube guidance and drive assembly 42 is removably mounted on frame 12 and more particularly on rails 36 via mounting legs 44 (FIG. 3) which are removably insertable into openings 46 formed in each of rails 36. Mounting legs 44 and the mounting mechanism of which they are a part are described in further detail in the copending application entitled Pilot Tube System And Attachment Mechanism for Auger Boring Machine which is incorporated herein by reference and filed concurrently herewith. Assembly 42 when mounted on frame 12 is positioned so that a central longitudinal axis X of a pilot tube 48 is coaxial with a longitudinal axis Y which passes centrally through output shaft 32 and about which shaft 32 is rotated when driving auger 34. Assembly 42 includes a generally circular rear plate 50 which abuts compartment 30 when assembly 42 is mounted on frame 12 and includes a portion which is inserted into compartment 30 to assist with the alignment of assembly 42.

Figures 4, 5:
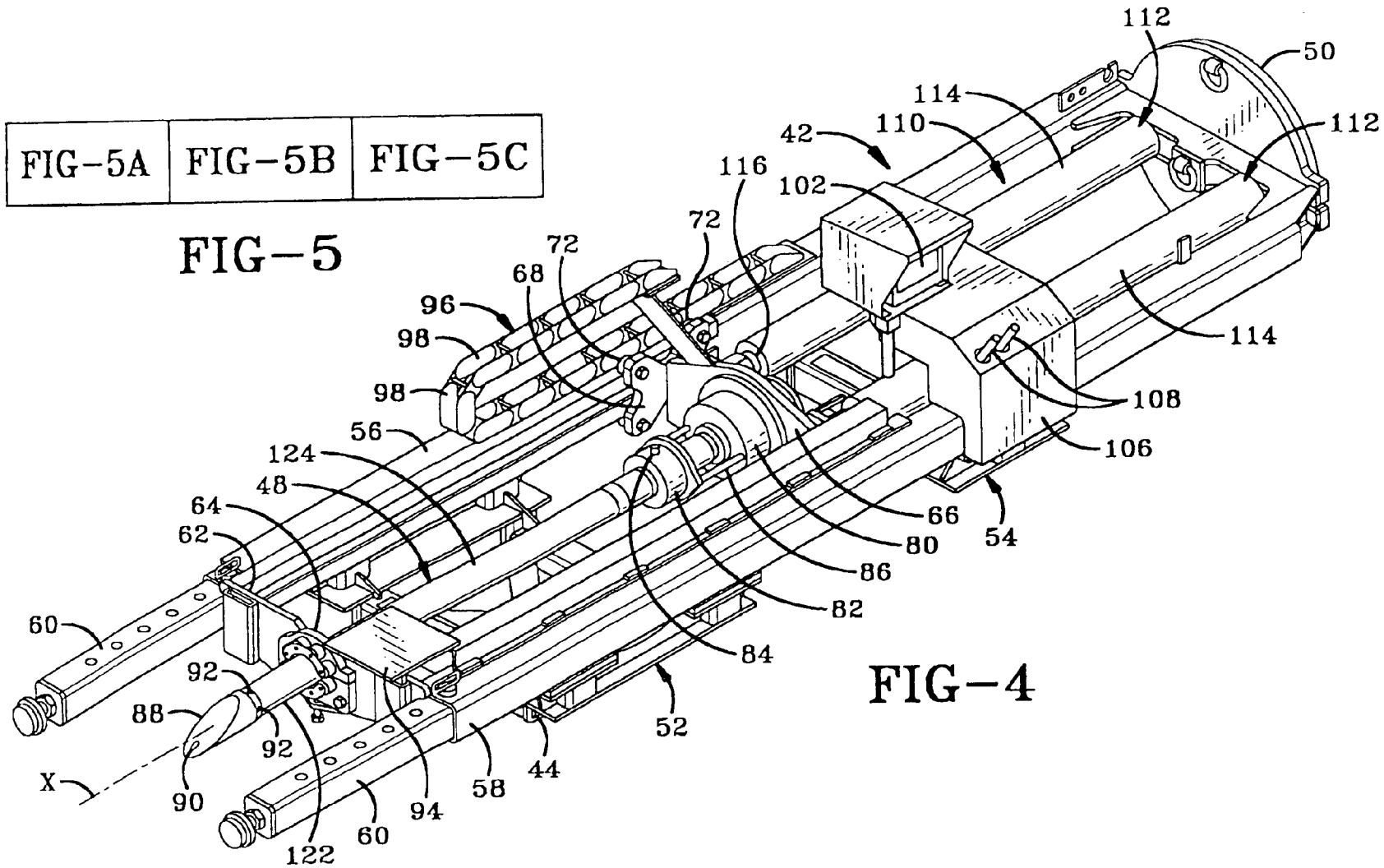
FIG. 4 is a perspective view of the drive and control mechanism.
FIG. 5 is a diagrammatic view showing the relation of FIGS. 5A, 5B, and 5C.
Figure 5A:
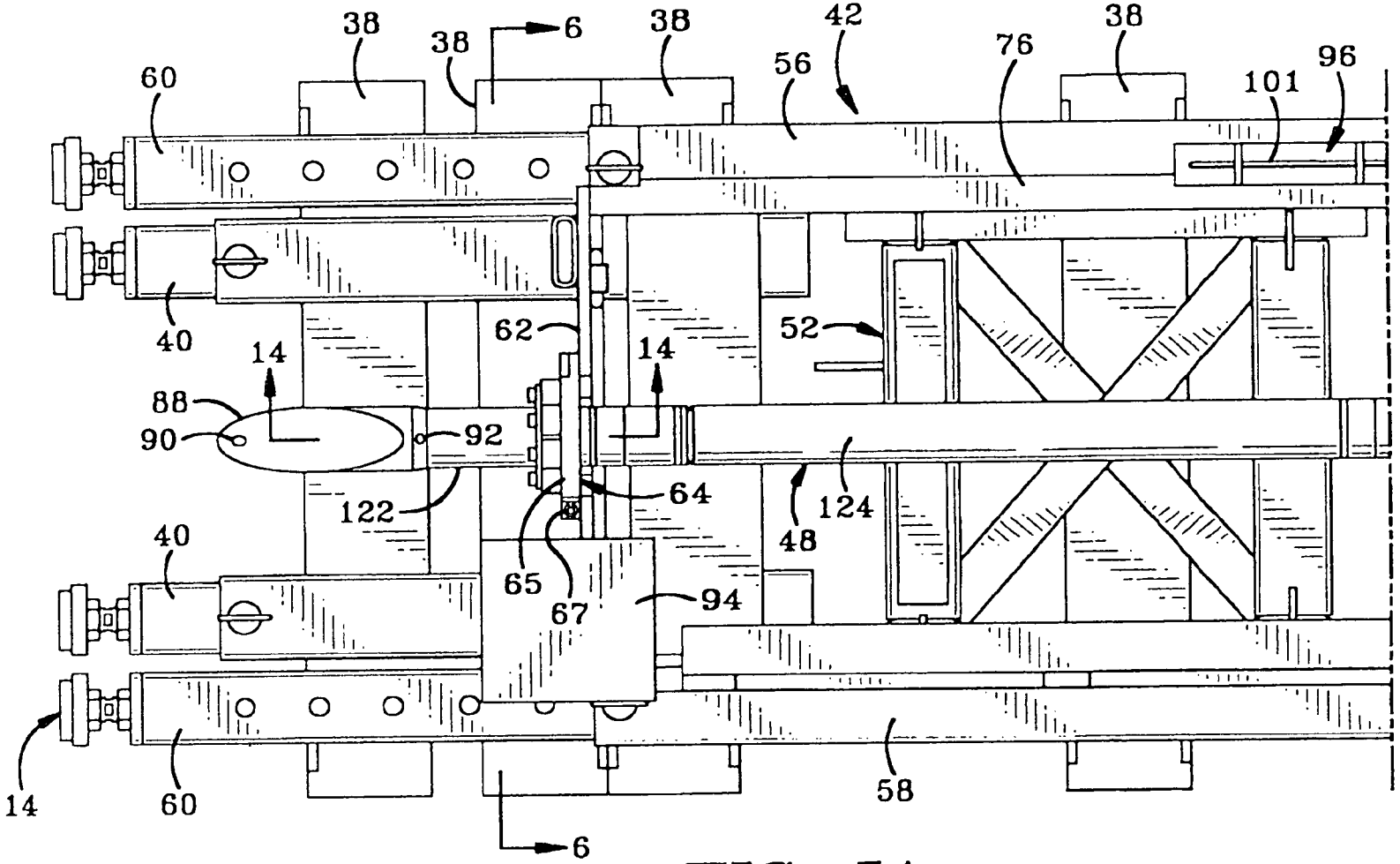
FIG. 5A is an enlarged top plan view of a front section of the pilot tube drive and control mechanism.
Figure 5B:
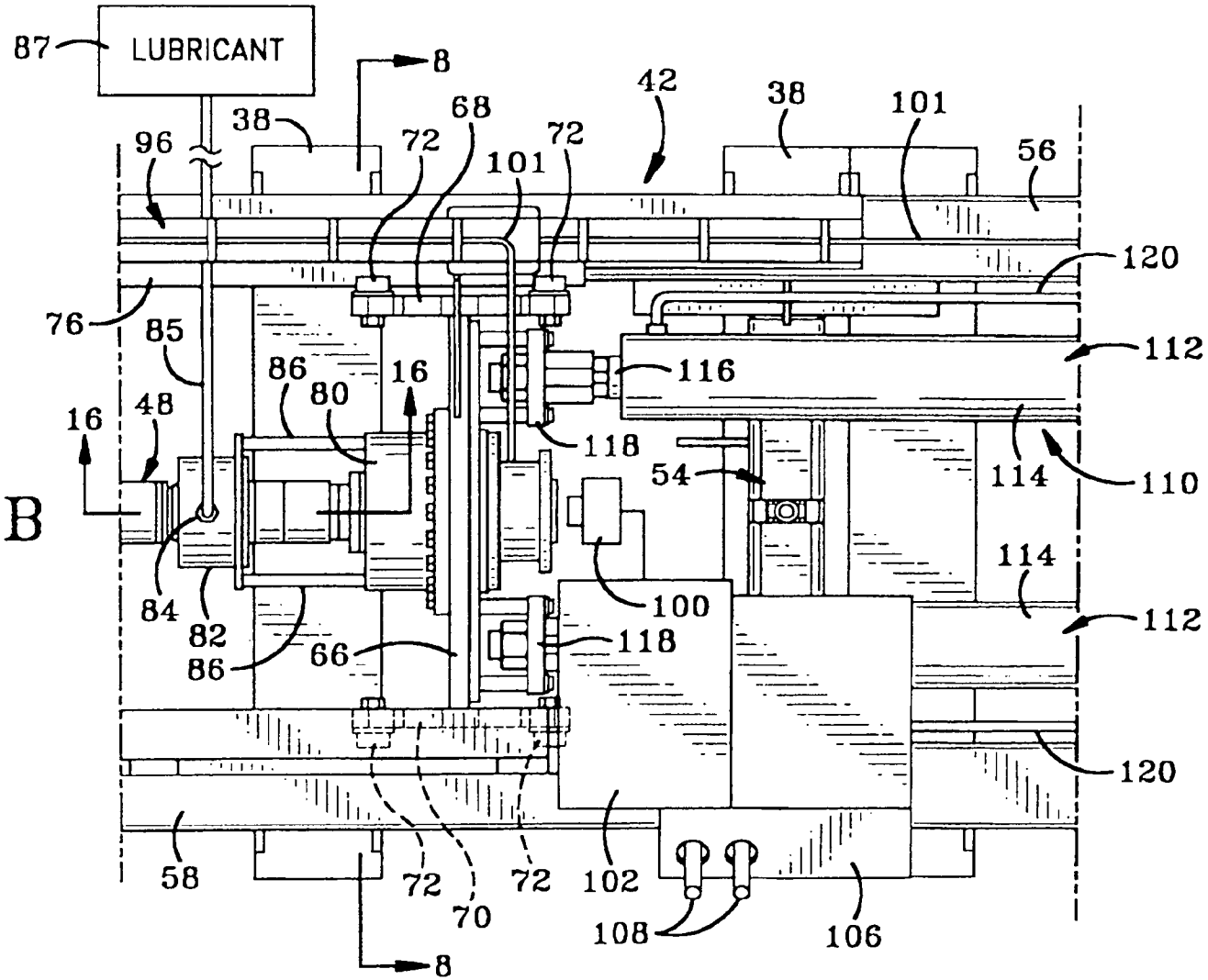
FIG. 5B is an enlarged top plan view of an intermediate section of the drive and control mechanism.
Figure 5C:
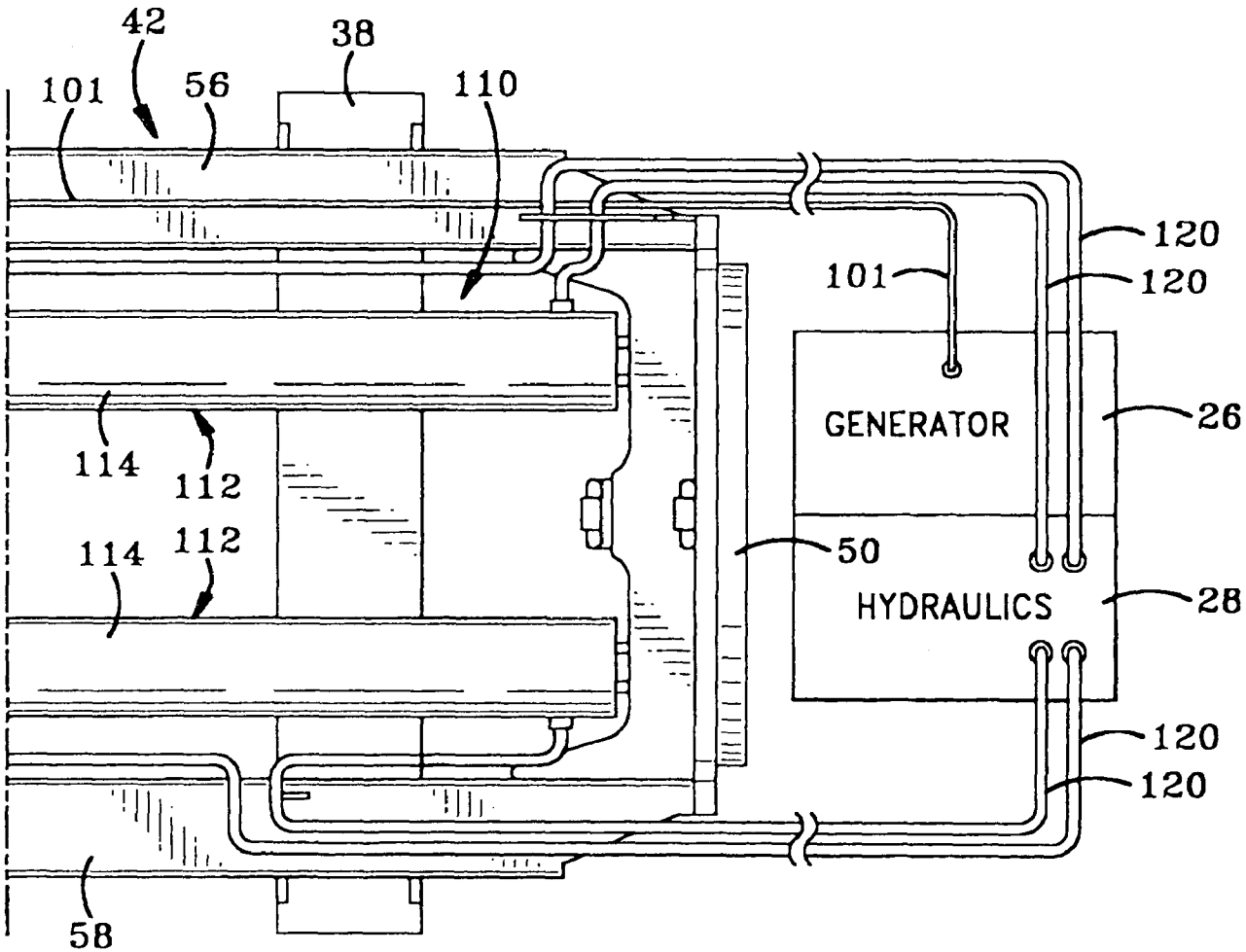
FIG. 5C is an enlarged top plan view of a rear section of the drive and control mechanism.

Referring to FIGS. 4-5C, assembly 42 includes front and rear mounting assemblies 52 and 54 which also serve as supports providing rigid structure extending axially across the width of assembly 42. Assemblies 52 and 54 are seated on rails 36 of frame 12 when assembly 42 is mounted on frame 12. A pair of longitudinally extending parallel spaced rails 56 and 58 are rigidly mounted on assemblies 52 and 54 and extend along most of the length of assembly 42. Adjustable stabilizing poles 60 are telescopically mounted respectively within first and second rails 56 and 58 and are adjustable to provide force against ground 8 in the same manner as poles 40.

Figure 8:
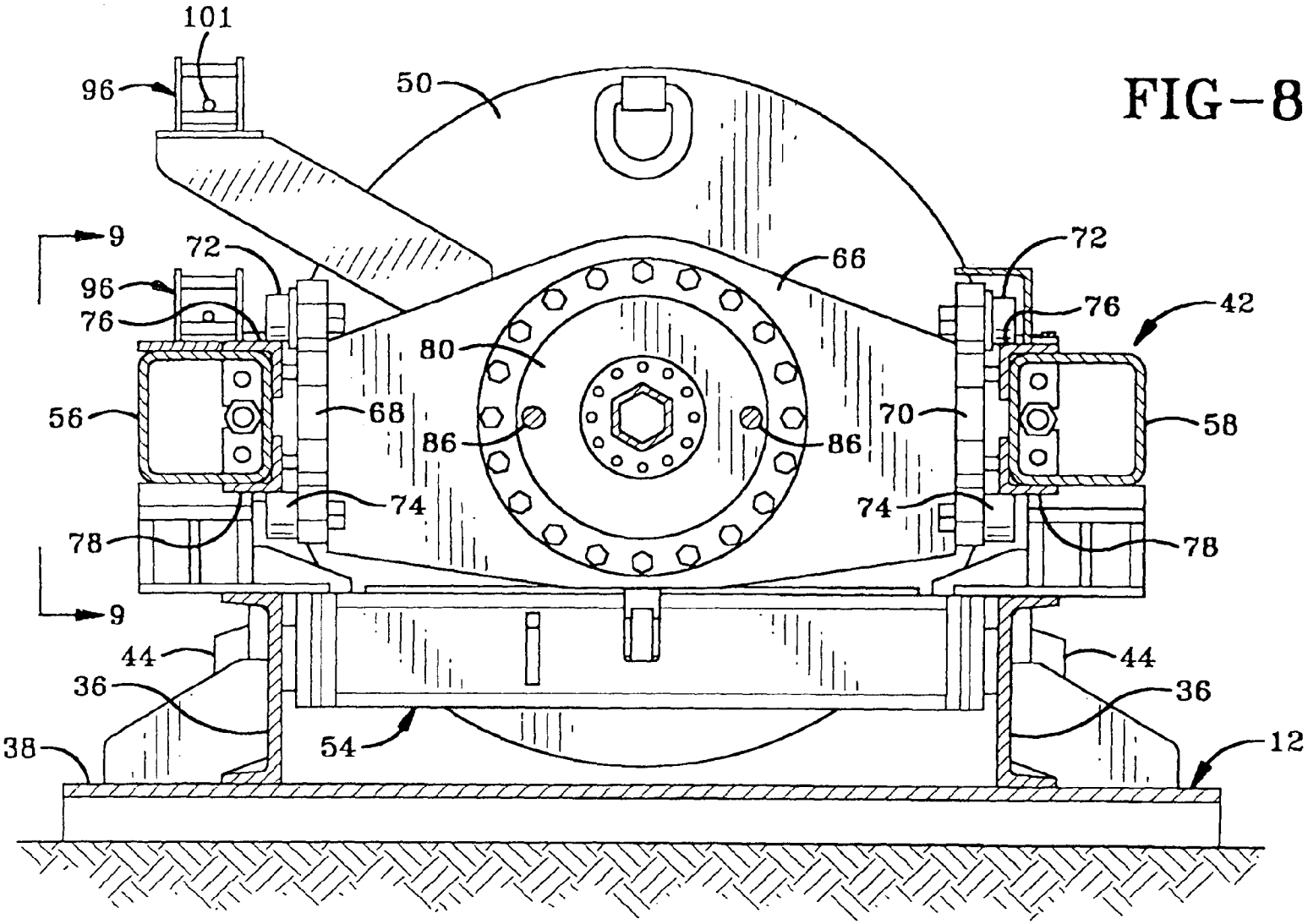
FIG. 8 is a sectional view taken on line 8-8 of FIG. 5B.
Figure 9:
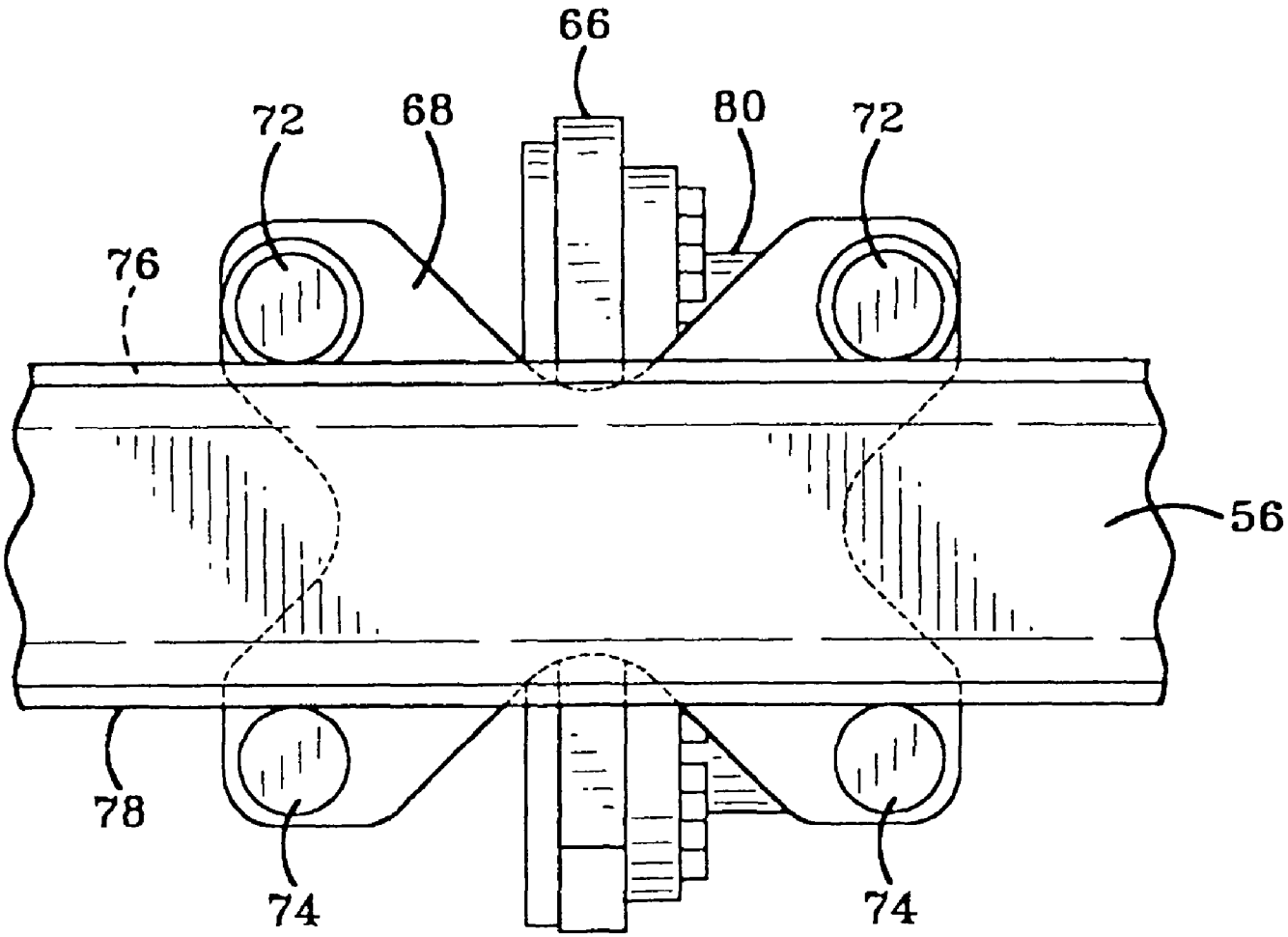
FIG. 9 is an enlarged fragmentary side elevational view of the roller assembly taken on line 9-9 of FIG. 8.

A rigid front cross member 62 extends between and is connected to each of rails 56 and 58 adjacent the front thereof with a front pilot tube support 64 mounted thereon centrally between rails 56 and 58. Support 64 includes a plurality of bearings which engage the pilot tube 48 to allow longitudinal movement of tube 48 as well as rotational movement of tube 48 about axis X to allow for the steering thereof. Rear plate 50 and associated structure attached thereto serve as a rear cross member for rigidly connecting rails 56 and 58 to one another at the rear of assembly 42. An intermediate cross member 66 extends axially between rails 56 and 58 and is supported respectively on rails 56 and 58 by first and second roller assemblies 68 and 70 (FIGS. 5B and 8). Each roller assembly includes a pair of longitudinally spaced upper rollers 72 and longitudinally spaced lower rollers 74 which respectively rollingly engage upper and lower surfaces 76 and 78 of respective rails 56 and 58. Upper and lower surfaces 76 and 78 are parallel surfaces which extend longitudinally from the front of rails 56 and 58 to around the midway point between the front and rear of said rails.

An electric guidance control motor 80 is mounted on cross member 66 for selectively rotating pilot tube 48 in either direction about axis X. A lubricant feed swivel 82 having a lubricant inlet 84 is mounted on motor 80 by a pair of spaced mounting rods 86 extending forward from motor 80. Swivel 82 is connected to pilot tube 48 and thus serves as an engaging member for drivingly engaging tube 48 during operation of assembly 42. As shown in FIG. 5B, inlet 84 of swivel 82 is in fluid communication with a lubricant feedline 85 which is in fluid communication with a source 87 of lubricant, which is typically water. Source 87 includes a pump for pumping water. Swivel 82 receives water through inlet 84 to pump the water through pilot tube 48 and through a steering head 88 connected to the front of pilot tube 48, the water flowing out a forward exit opening 90 and a plurality of lateral exit openings 92. A crane stand 94 is mounted on the frame of assembly 42 for supporting a crane (not shown) used for lifting pilot tube segments into position for connecting the various segments to form pilot tube 48 during the process of jacking or driving tube 48 to form the pilot hole. A cord carrier 96 is mounted atop rail 56 and includes a plurality of links 98 which are pivotally connected to one another so that electrical cords 101 (FIGS. 5A-5C) will not become tangled during the longitudinal driving of pilot tube 48. A support arm extends from cross member 66 to one of links 98 to provide support to the upper section of carrier 96. Electrical cord 101 is electrical communication with motor 80 as shown in FIG. 5B and with generator 26 as shown in FIG. 5C.

During the jacking and driving of pilot tube 48, a steering mechanism keeps tube 48 on line and grade using a theodolite which utilizes a camera 100 (FIG. 5B) in electrical communication with a display monitor 102 which displays the view of the camera through pilot tube 48 of an illuminated LED target 104 (FIGS. 14-15) disposed within pilot tube 48 adjacent steering head 88. In order for camera 100 to view LED target 104, pilot tube 48 is hollow, as are the other structures intermediate camera 100 and target 104, such as motor 80 and swivel 82, in order to provide a line of sight Z (FIGS. 10, 13, 14, 16) between camera 100 and target 104. A guidance control unit 106 is mounted on rail 58 and includes manually operable controls 108 typically in the form of joysticks in electrical communication with motor 80 in order to send a signal to motor 80 to control rotation of pilot tube 48.

In accordance with one of the features of the invention and with reference to FIGS. 4, 5B and 5C, assembly 42 includes a continuous stroke drive mechanism 110 comprising a pair of hydraulic actuators in the form of piston-cylinder combinations 112. Each combination 112 includes a cylinder 114 and a piston 116 slidably received therein. Each cylinder 114 is mounted on the rear cross member adjacent plate 50 while each piston 116 is mounted on intermediate cross member 66 via a respective pair of mounting brackets 118 (FIG. 5B). A pair of hydraulic lines 120 (FIGS. 5B-5C) extends from hydraulic pump 28 to each of hydraulic cylinders 114 with one of lines 120 connected to cylinder 114 adjacent the rear end thereof and the other connected adjacent the front end thereof in order to respectively provide extension and retraction of the respective piston 116. Pistons 116 extend and retract simultaneously along paths that are parallel to one another and substantially parallel to axis X of pilot tube 48. Combinations 112 must provide a substantial amount of forward and reverse thrust. For example, the forward thrust produced by combinations 112 on one preferred embodiment has a maximum thrust of 280,000 pounds while the reverse thrust has a maximum thrust of 140,000 pounds. Combinations 112 are capable of a continuous stroke throughout the extension thereof and likewise during the retraction thereof.

The stroke capability of drive mechanism 110 will be detailed further after a more detailed description of pilot tube 48. Pilot tube 48 is made up of a plurality of pilot tube segments which are connected end to end to sequentially increase the length of pilot tube 48 during the jacking process. Typically, all or nearly all of the pilot tube segments are of the same length and are interchangeable with one another. However, some of the pilot tube segments may be of a different length, such as the lead pilot tube segment 122, which is connected to steering head 88 and which is shorter than the standard pilot tube segments 124 connected sequentially behind segment 122. Lead pilot tube segment 122 has a length of roughly two feet while pilot tube segments 124 typically come in lengths of five feet although this may vary. More particularly, tube segments 124 have an end to end length L1 (FIG. 10) measured between the leading and trailing ends 126 and 128 thereof. While length L1 is typically five feet as noted above, the tube segments may have a length of three feet, four feet or greater than five feet. If the lengths of the pilot tube segments are too short, they may became less practical for various reasons while tubes reaching greater lengths may become less desirable due to the substantial weight of the tubes and the additional length of the boring machine and the pit required for positioning the machine therein.

Most preferably, drive mechanism 110 is capable of driving cross member 66 and the associated structure mounted thereon which engages pilot tube 48 along a length equal to or greater than length L1 (FIGS. 17-18) in a single continuous stroke. However, even if drive mechanism 110 does not drive pilot tube 48 in a single continuous stroke over length L1, it nonetheless allows tube 48 to be driven a distance equal to or greater than length L1 while the frame of assembly 42 remains in a stationary position, in this case mounted on the main frame 12 of auger boring machine 10. Thus, each of pistons 116 and each of cylinders 114 have a length which is equal to or greater than length L1 to allow for extension and retraction of pistons 116 over said length. Likewise, upper and lower surfaces 76 and 78 have a longitudinal length which is equal to or greater than length L1 to allow roller assemblies 68 and 70 to move over said length. During the extension and retraction of pistons 116, rollers 72 and 74 of assemblies 68 and 70 maintain contact with upper and lower surfaces 76 and 78 of rails 56 and 58 in order to eliminate vertical play of intermediate cross member 66 and the associated structure connected thereto.

Figure 6:
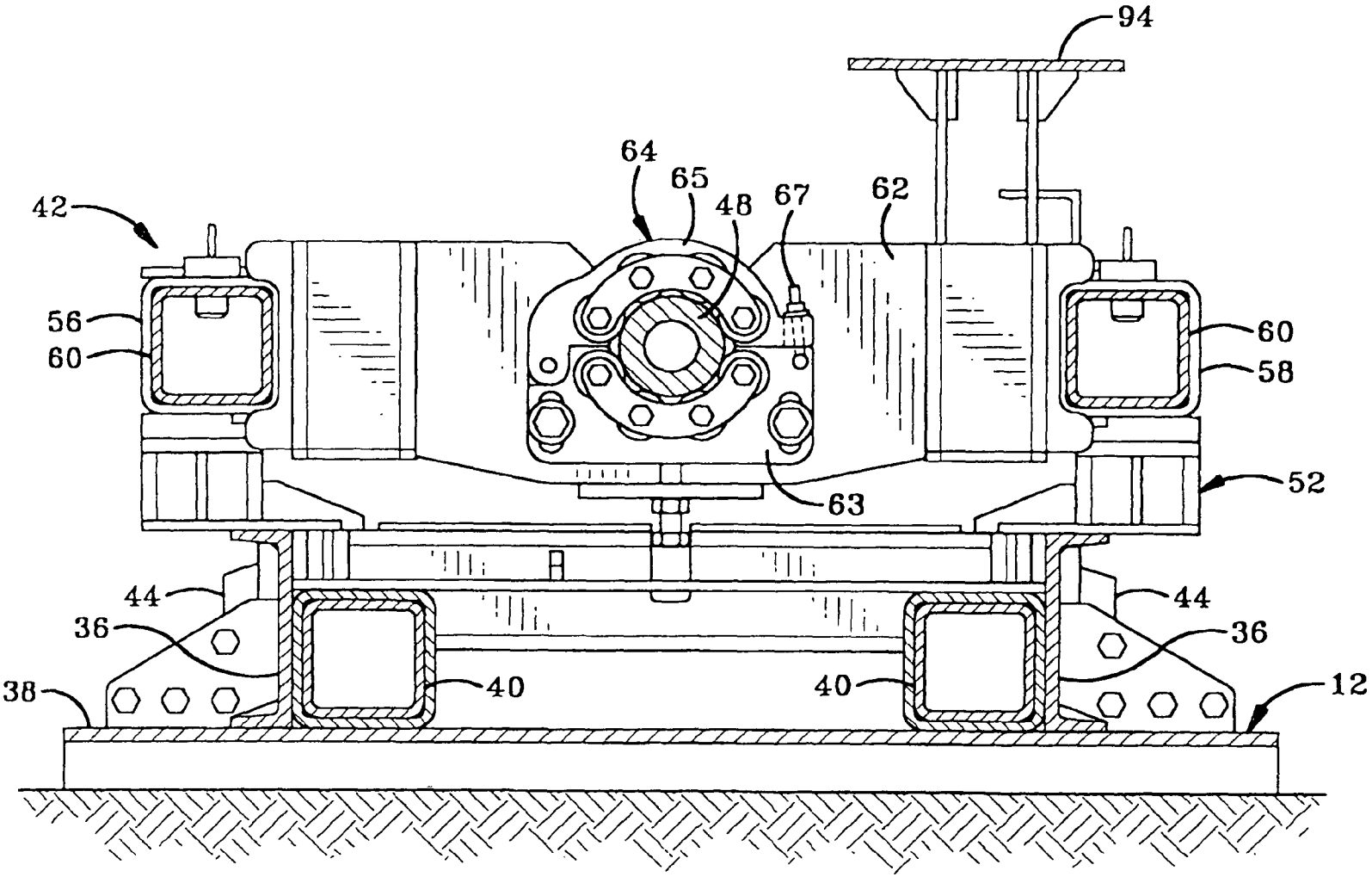
FIG. 6 is a sectional view taken on line 6-6 of FIG. 5A.
Figure 7:
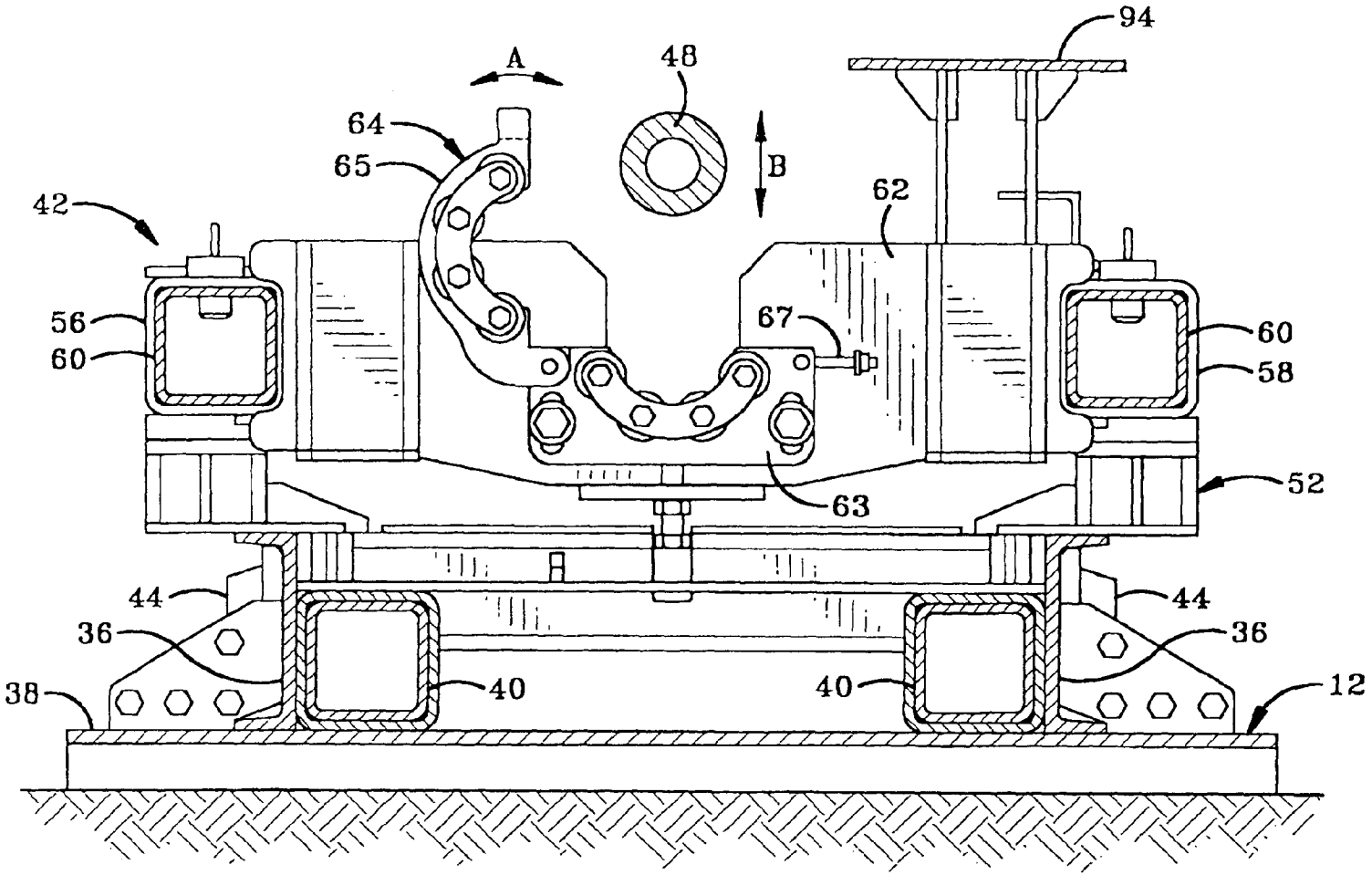
FIG. 7 is similar to FIG. 6 and shows the pilot tube mounting collar in an open position to allow installation and removal of the pilot tube therefrom.

FIGS. 6-7 show pilot tube support 64 in greater detail. Support 64 has a lower portion 63 mounted on front cross member 62 and an upper portion 65 pivotally mounted on lower portion 63 and releasably connected to portion 63 by a fastener 67. Upper portion 65 may thus pivot between the closed and secured position shown in FIG. 6 to the open position shown in FIG. 7 as shown at arrow A to allow pilot tube 48 to be installed or removed therefrom as shown at arrow B in FIG. 7.

Figure 10:
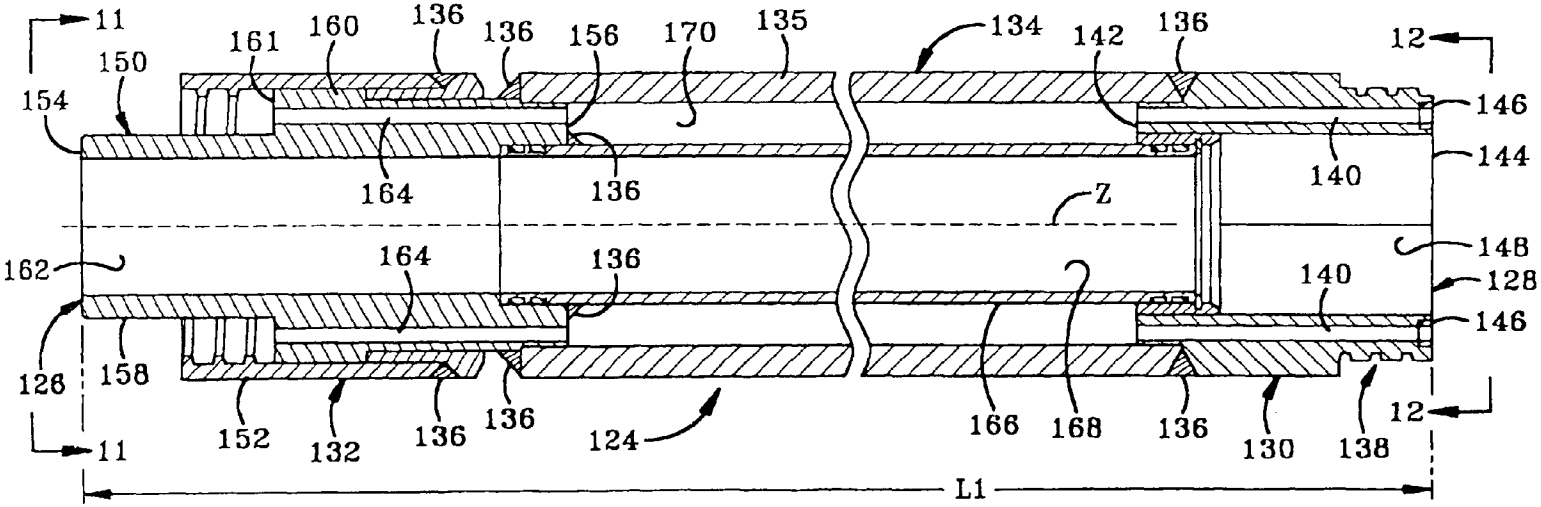
FIG. 10 is a fragmentary sectional view taken along the longitudinal axis of a pilot tube segment showing the internal structure thereof and the coupling members.
Figure 12:
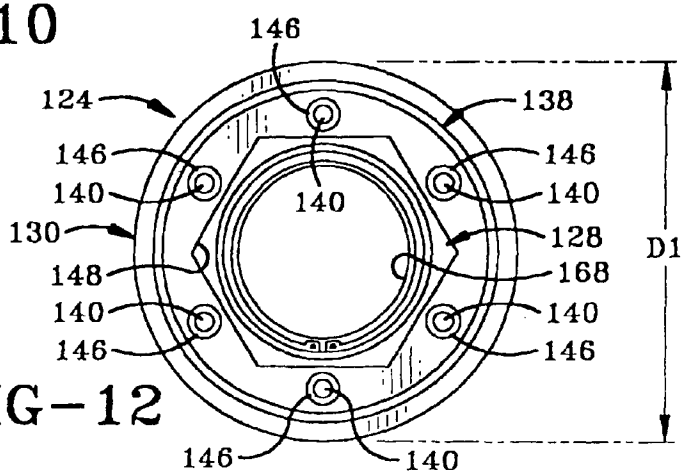
FIG. 12 is an end elevational view taken on line 12-12 of FIG. 10 showing the other coupling member.
Figure 11:
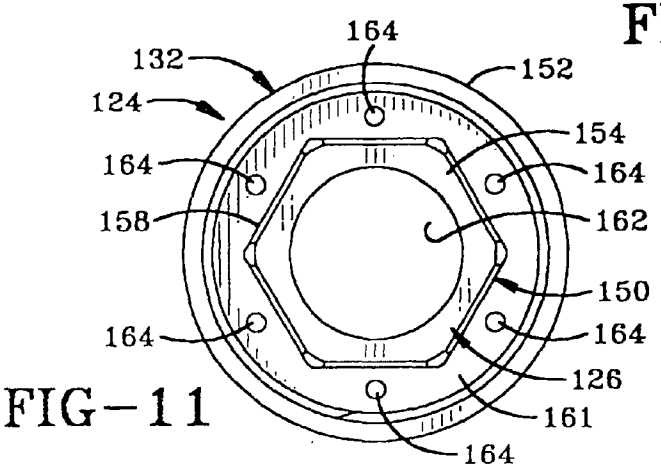
FIG. 11 is an end elevational view taken on line 11-11 of FIG. 10 showing one of the coupling members.

As noted previously, pilot tube 48 is configured to allow a lubricant such as water to flow therethrough to steering head 88. Some of the lubricant passages of pilot tube 48 are discussed with reference to FIGS. 10-12. More particularly, FIG. 10 shows a sectional view of a pilot tube segment 124 which in part shows the lubricant passages therethrough. Tube segment 124 is formed of a heavy duty metal with sufficient strength to withstand the thrust forces noted earlier. Segment 124 has first and second coupling ends or members 130 and 132 having a mating configuration with one another so that a first coupling member 130 of tube segment 124 may be coupled to a second coupling member 132 of another tube segment 124 to form pilot tube 48 during the process of driving the pilot tube. Members 130 and 132 are respectively connected at either end of a central section 134 by welds, which are indicated generally at 136 in various places. Central section 134 includes an outer pipe 135. Each of outer pipe 135 and coupling members 130 and 132 have an outer diameter D1 (FIG. 12). First coupling member 130 includes an externally threaded end portion 138 stepped inwardly from the outer surface defining diameter D1 thereof. Six lubricant passages 140 are formed in first coupling member 130 and extend from a leading end 142 thereof to a trailing end 144 thereof. Passages 140 are circumferentially equally spaced from one another as shown in FIG. 12. Each passage 140 has a counter bore adjacent end 144 in which a respective seal 146 is disposed. A central hexagonal opening 148 extends inwardly from trailing end 144 with passages 140 disposed radially outwardly thereof.

Second coupling member 132 includes an inner member 150 and an outer member in the form of an internally threaded collar 152 which is rotatably mounted on inner member 150 and configured to threadably engage the threaded portion 138 of a coupling member 130 of another pilot tube segment 124. Inner member 150 has a leading end 154 and a trailing end 156 and includes a hexagonal segment 158 which is receivable within and has a mating configuration with hexagonal opening 148 of first coupling member 130. Inner member 150 includes an annular wall 160 which is connected to a trailing end of segment 158 and extends radially outwardly therefrom. Wall 160 has a leading end 161 which extends perpendicular to segment 158. A central passage 162 extends from leading edge 154 to trailing edge 156 and six lubricant passages 164 are disposed radially outwardly of passage 162 and are circumferentially evenly spaced from one another in order to align with passages 140 when a first and second coupling member 130 and 132 are joined to one another.

Pilot tube segment 124 further includes an inner pipe 166 defining a central passage 158 which communicates with passage 162 and opening 148 so that a through passage is formed in segment 124 extending from leading edge 126 to trailing edge 128 thereof. Inner pipe 166 is connected to inner member 150 and first coupling member 130 in a manner to provide an annular lubricant passage 170 between inner pipe 166 and outer pipe 135.

Figure 13:
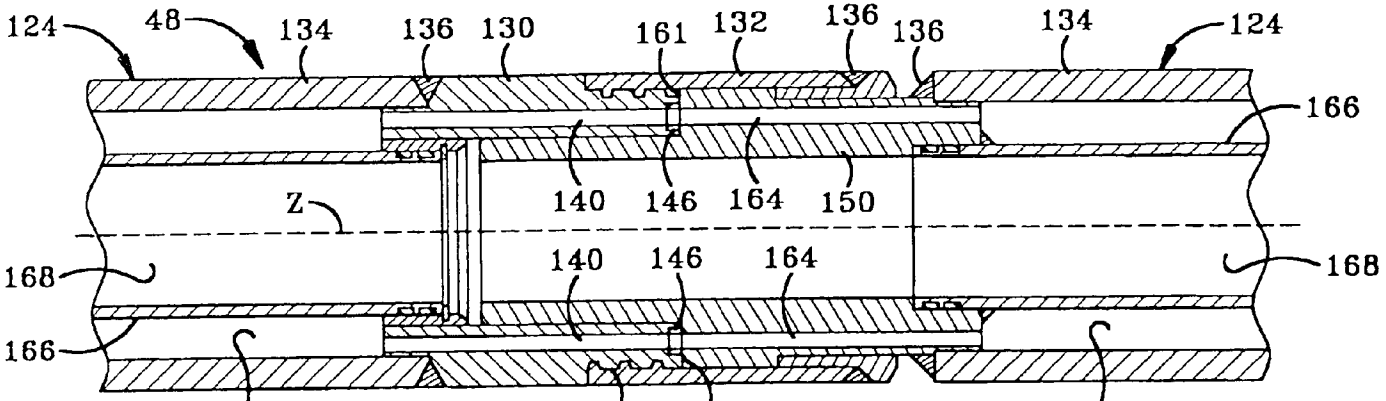
FIG. 13 is a sectional view showing the connection between the pilot tube segments via the connection of the coupling members.

Passage 170 communicates with the trailing ends of lubricant passages 164 and the leading ends of lubricant passages 140 in order to provide a lubricant passage through pilot tube segment 124 from leading edge 126 to trailing edge 128. Other than the communication of passage 170 with passages 164 and 140, passage 170 is sealed so that it does not communicate with central passage 168 or to the outer surface of outer pipe 135. Passages 162 and 168 and opening 148 provide for line of sight Z extending therethrough along which camera 100 is able to view LED target 104. FIG. 13 shows two pilot tube segments 124 connected via the coupling of members 130 and 132 via the threaded engagement there between. Passages 140 are aligned respectively with passages 164 with seals 146 performing a seal against leading end 161 of inner member 150.

Figure 14:
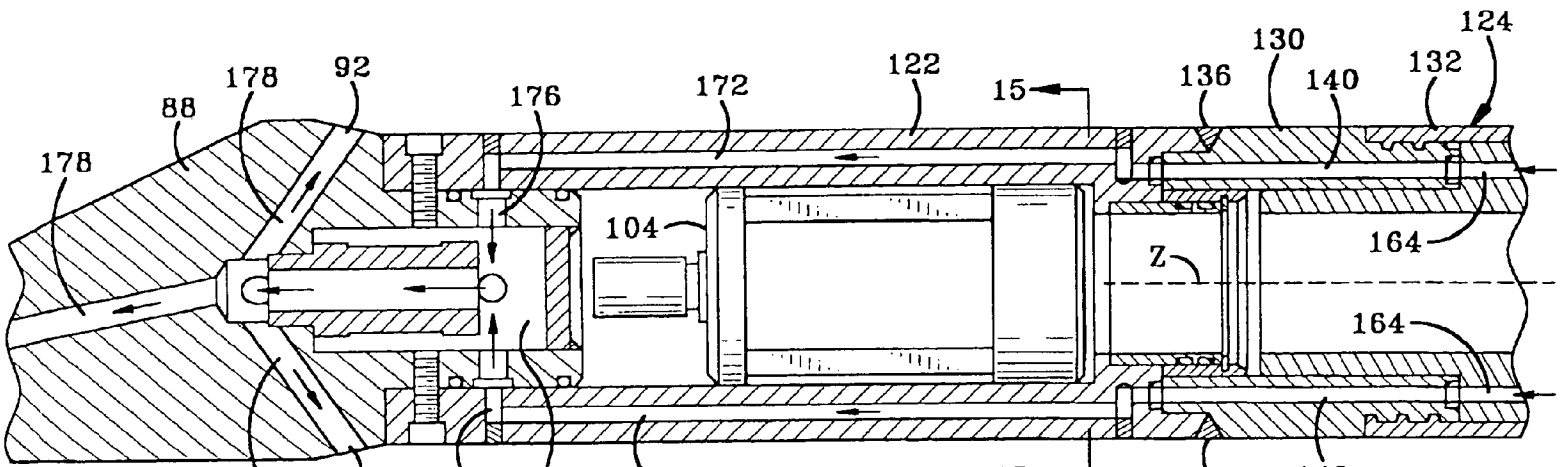
FIG. 14 is a fragmentary sectional view taken on line 14-14 of FIG. 5A showing a leading pilot tube segment with the LED target disposed therein and connected to the steering head and a trailing pilot tube segment.
Figure 15:
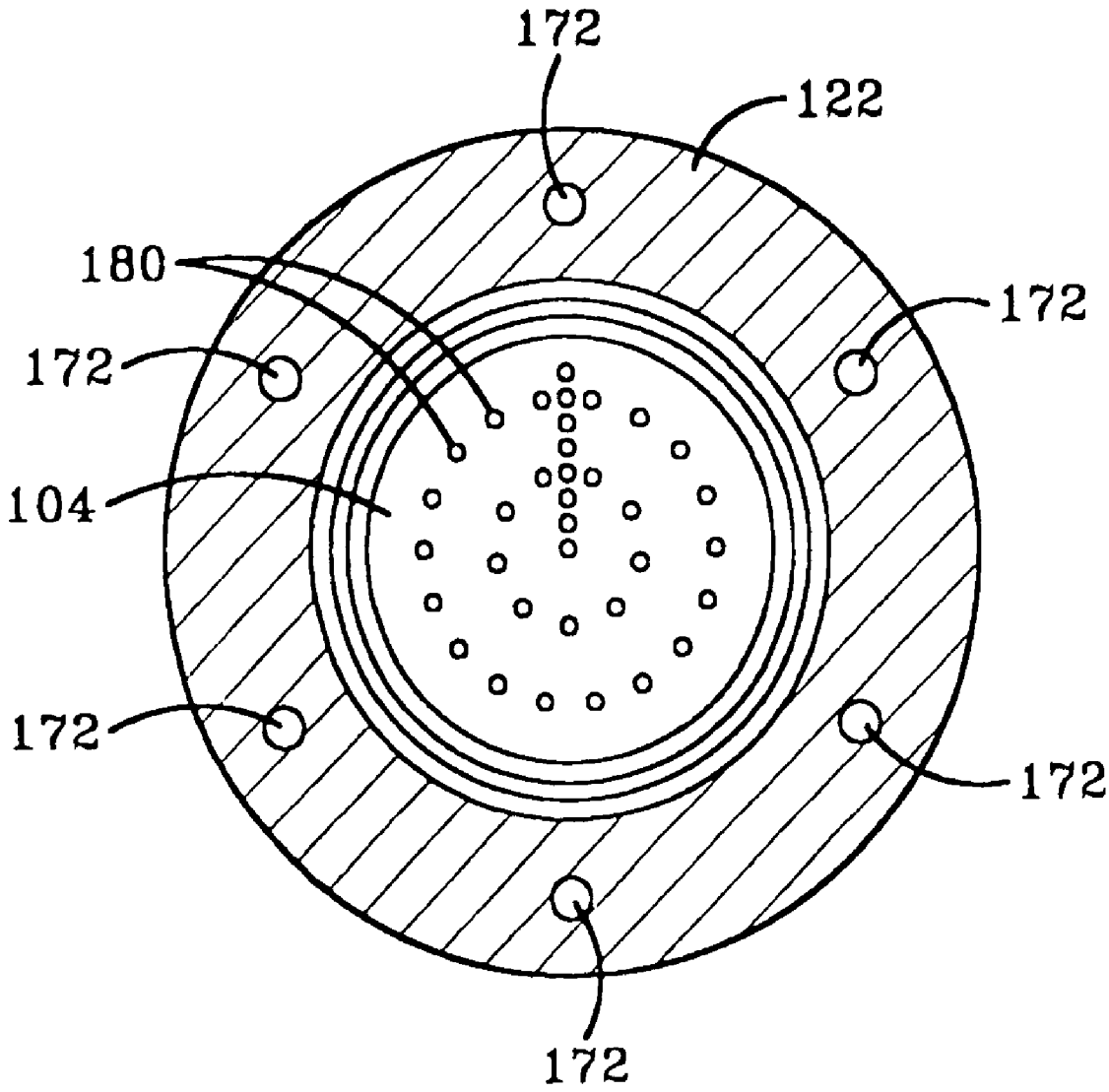
FIG. 15 is a sectional view taken on line 15-15 of FIG. 14 showing the LED target within the leading pilot tube segment.

FIG. 14 shows additional passages in pilot tube 48 allowing for a flow of lubricant therethrough to steering head 88. More particularly, FIG. 14 shows that lead pilot tube segment 122 includes a first coupling member 130 which is connected to a second coupling member 132 of a pilot tube member 124 to align the respective passages thereof. Unlike pilot tube segment 124, segment 122 is shorter and configured to carry target 104 therein, and thus does not include an annular central passage such as passage 170 of segment 124. Instead, six lubricant passages 172 are formed therethrough in a manner similar to passages 140 and passages 164 in order to allow communication with passages 140 of coupling member 130. Passages 172 merge into a central chamber 174 formed in the rear portion of steering head 88 via respective passages 176 which extend radially outwardly from chamber 174. Several other passages 178 are formed in steering head 188 downstream of central chamber 174 which communicate with the outer surface of steering head 88 via exit openings 90 (FIG. 4) and 92. FIG. 14 further shows that lead tube segment 122 defines a central passage providing for line of sight Z therethrough to provide a clear view of illuminations 180 (FIG. 15) of target 104.

Figure 16:
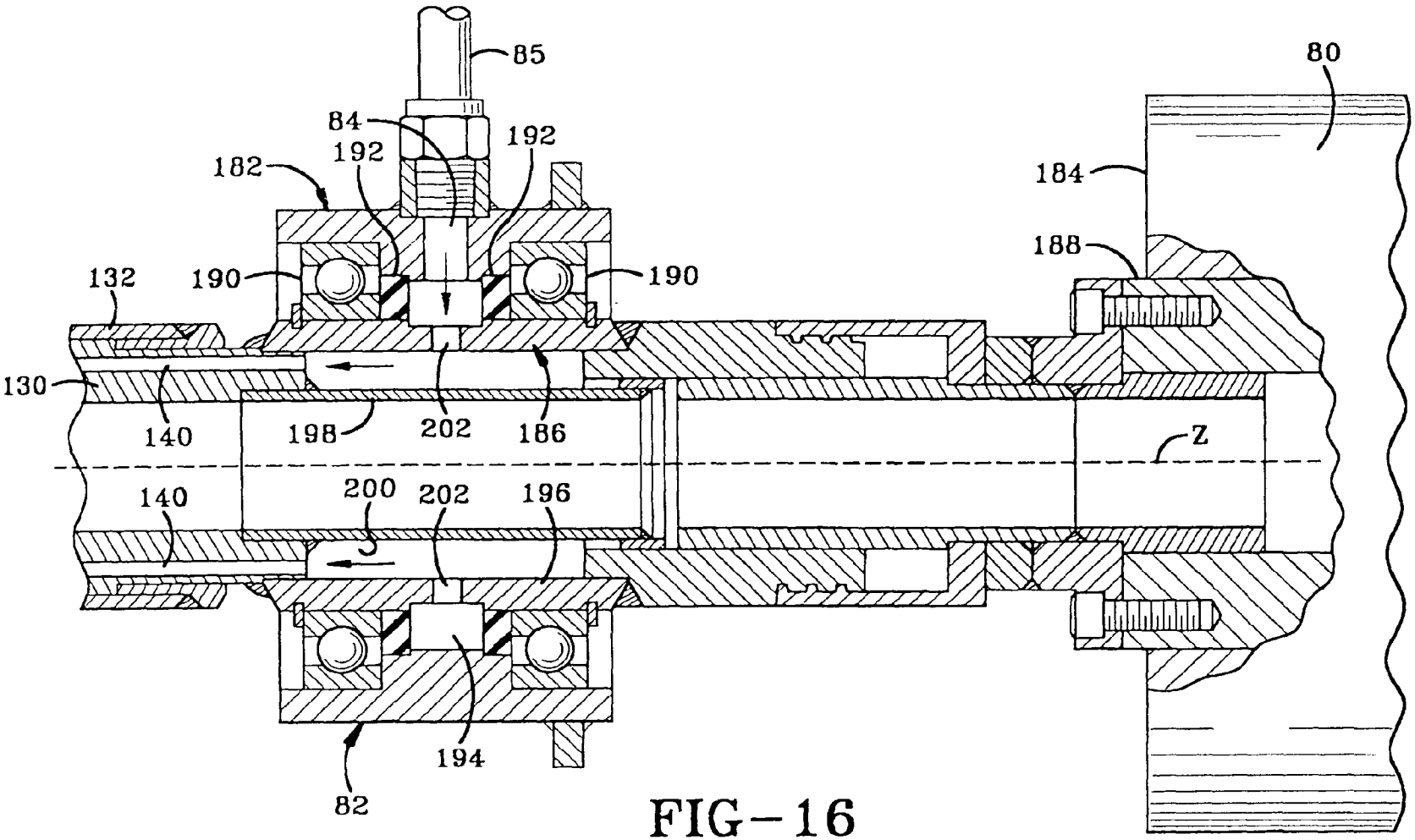
FIG. 16 is a sectional view taken on line 16-16 of FIG. 5B showing the lubricant feed swivel.

FIG. 16 shows a sectional view of the lubricant feed swivel 82 and portions of motor 80 along with the connecting members associated therewith. FIG. 16 illustrates a central passage through motor 80, swivel 82 and the connecting structure associated therewith so that line of sight Z is maintained. FIG. 16 also illustrates the initial portions of the lubricant passage within pilot tube 48 and the connection of swivel 82. More particularly, feed swivel 82 includes a stationary housing 182 which is mounted on a stationary housing 184 of motor 80 via rods 86 (FIG. 4). Swivel 82 also includes a rotatable portion 186 which is connected to a rotatable drive 188 of motor 80 to rotate therewith. Portion 186 is rotatably mounted within housing 182 by a pair of longitudinally spaced ring bearings 190 with a pair of annular seals 192 disposed between bearings 190 and respectively abutting said bearings.

Seals 192 define there between an annular lubricant passage 194 which is in communication with inlet 84. Rotatable portion 186 includes outer and inner pipes 196 and 198 defining there between an annular lubricant passage 200. Outer pipe 196 defines a plurality of radially extending and circumferentially spaced lubricant passages 202 in fluid communication with annular passages 194 and 200. Thus, passages 140 of coupling member 130 are in communication with annular passage 200. The configuration of feed swivel 82 allows for the rotation of portion 186 while maintaining continuous fluid communication between passages 202 and annular passage 194. A first connecting member 130 is connected to outer and inner pipes 196 and 198 and extends forward therefrom to couple with a second coupling member 132 in order to provide connection with the remainder of pilot tube 48. The arrows in FIGS. 14 and 16 indicate the flow of lubricant through the various passages from swivel 82 through pilot tube 48 and steering head 88. The lubrication system of assembly 42 is described in further detail in the copending application entitled Lubricated Pilot Tubes For Use With Auger Boring Machine Pilot Steering System which is incorporated herein by referenced and filed concurrently herewith.

Figure 17:
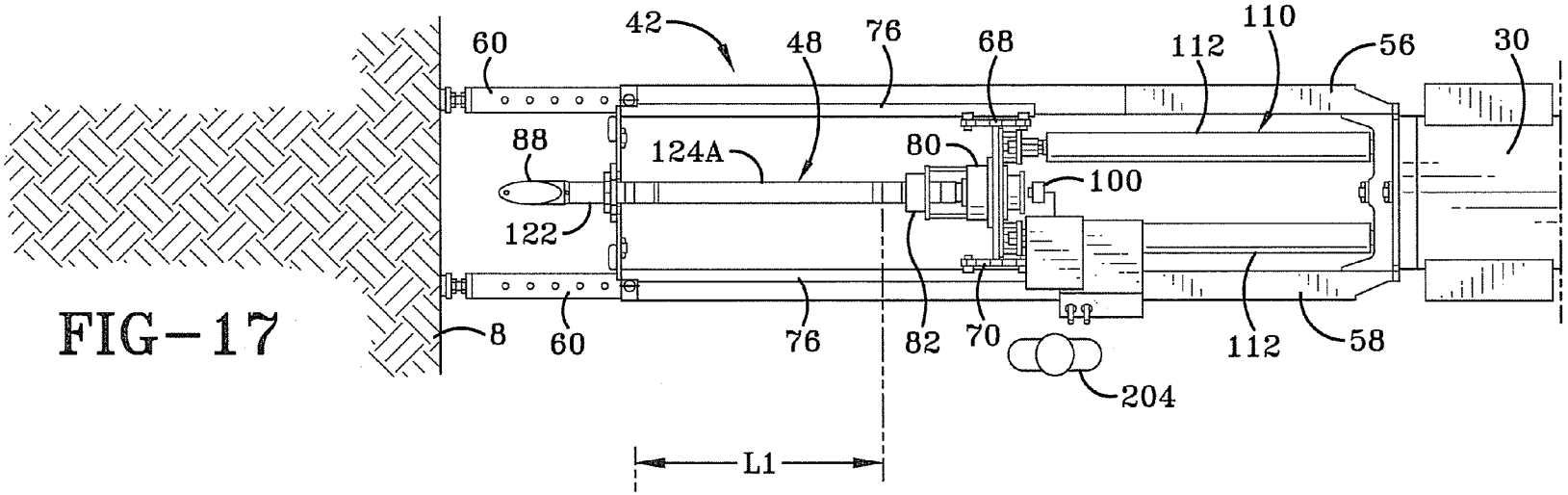
FIG. 17 is a top plan view of the pilot tube drive mechanism prior to formation of the pilot hole.
Figure 18:
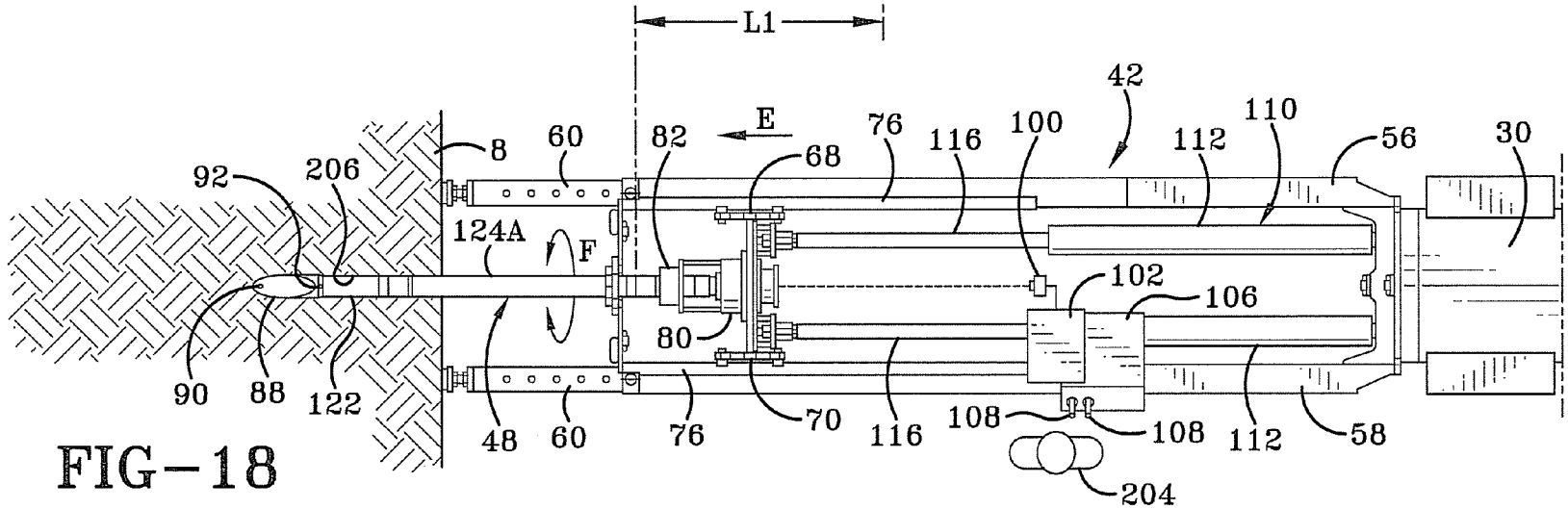
FIG. 18 is a top plan view of the drive mechanism showing an extension of the hydraulic actuators to provide an initial stage of pilot hole formation and also showing the steering capability of the pilot tube.

The operation of boring machine 10 is now described with reference to FIGS. 17-25. FIGS. 17-22 are shown without main frame 12 of machine 10 for simplicity. FIG. 17 shows assembly 42 prior to the jacking or driving of pilot tube 48 to form a pilot hole with an operator 204 preparing to begin operation of assembly 42. The pistons of piston cylinder combinations 112 are shown in a fully retracted position FIG. 17. Assembly 42 is operated to actuate combinations 112 in order to extend pistons 116 thereof to drive pilot tube 48 into ground 8 as indicated in arrow E in FIG. 18 to form the initial stages of a pilot hole 206. During the extension of pistons 116 and pilot tube 48, camera 100 senses or receives input from LED target 104 and relays the images of illuminations 180 on the monitor 102. Operator 204 views display monitor 102 in order to determine whether steering head 88 needs to be adjusted to maintain the line and grade of pilot tube 48. Operator 204 will use controls 108 in order to make any necessary adjustments, specifically rotating pilot tube 48 as indicated in arrow F in FIG. 18 via motor 80. For use with longer pilot holes, machine 10 may include additional steering control mechanisms, as described in further detail in the copending application entitled Auger Boring Machine With Two-Stage Guidance Control System which is incorporated herein by referenced and filed concurrently herewith. Simultaneously with driving and steering pilot tube 48, water may be pumped through pilot tube 48 via swivel 82 to steering head 88 and through the exit openings thereof in order to facilitate the formation of pilot hole 206. At this early stage of pilot hole formation, only one of the standard size pilot tubes 124A is being used, as shown in FIGS. 17 and 18. As previously described, drive mechanism 110 thus drives pilot tube 48 for the entire length of tube segment 124A or farther, while the frame of assembly 42 remains stationary and preferably with a single continuous stroke of pistons 116. Likewise, roller assemblies 68 and 70 travel along surfaces 76 and 78 this distance and pistons 116 extend this distance as well.

Figure 19:
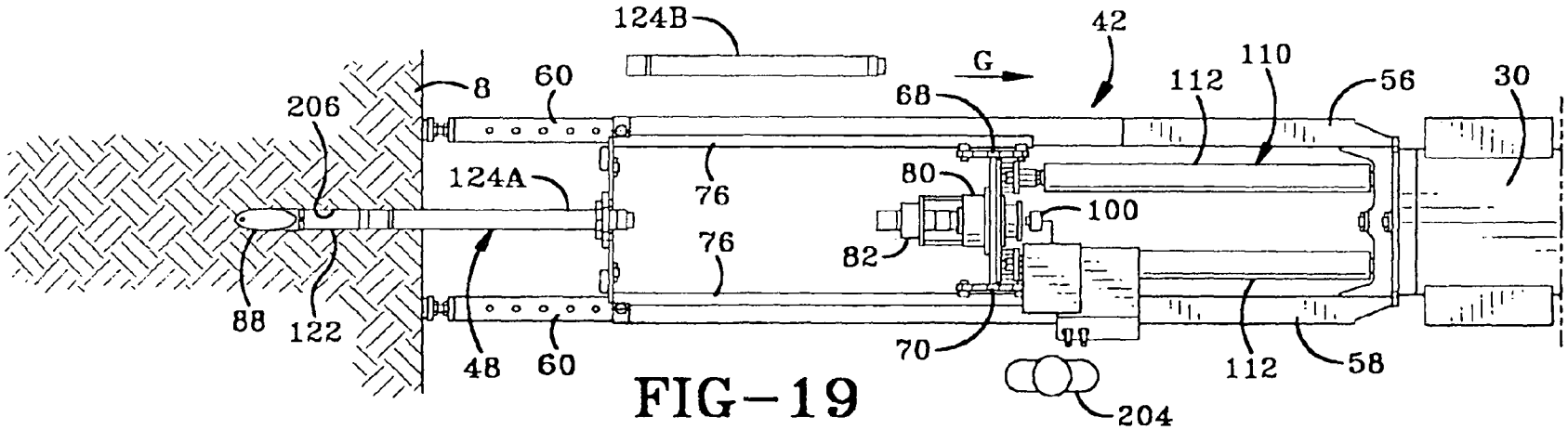
FIG. 19 is similar to FIG. 18 and shows retraction of the hydraulic actuators and a subsequent pilot tube segment prior to installation.
Figure 20:
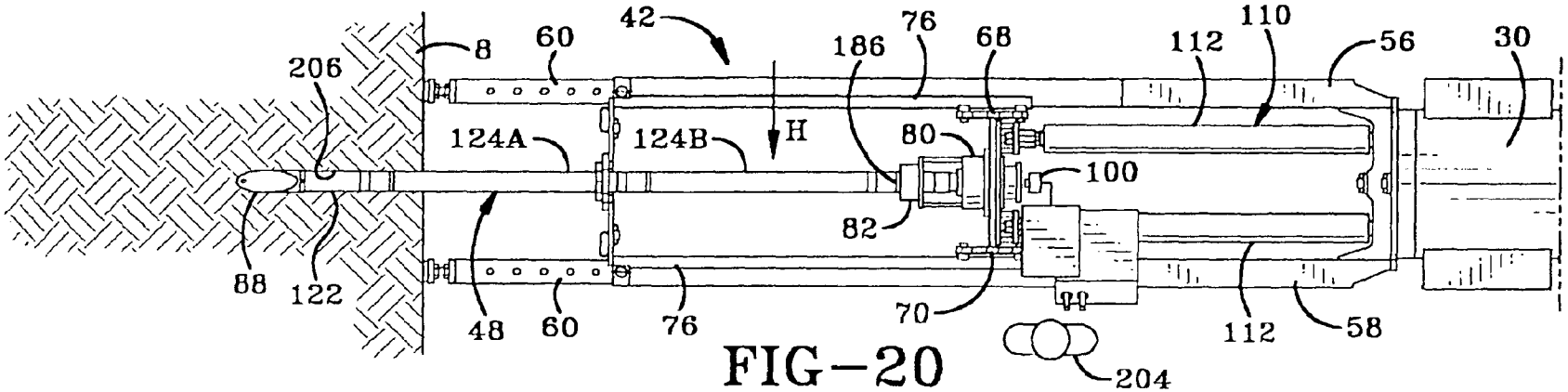
FIG. 20 is similar to FIG. 19 and shows the subsequent pilot tube segment connected to the previously driven pilot tube segment and the drive mechanism.
Figure 21:
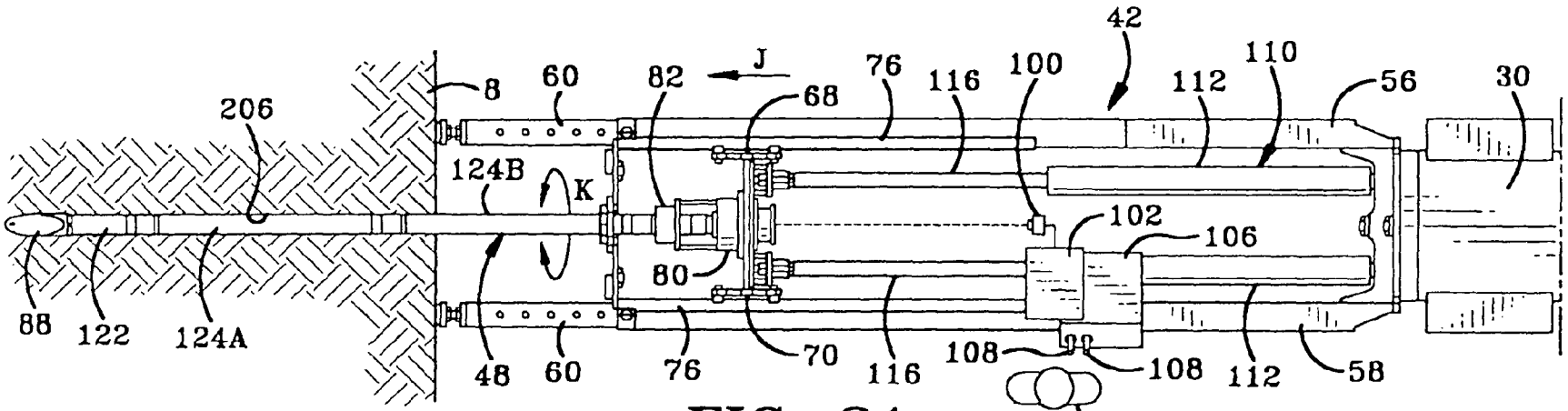
FIG. 21 is similar to FIG. 20 and shows the extension of the hydraulic actuators of the drive mechanism to drive the pilot tube with the newly installed pilot tube segment thereof to lengthen the pilot hole.

Once the initial driving of tube 48 is performed, pistons 112 are retracted as shown in FIG. 19 at arrow G as a second pilot tube segment 124B is prepared to be added to pilot tube 48. FIG. 20 shows pilot tube segment 124B being positioned and connected to tube segment 124A and rotatable portion 186 of swivel 82 as indicated at arrow H in preparation for additional driving of tube 48. Drive mechanism 110 is then operated to extend piston 116, roller assemblies 68 and 70 and pilot tube 48 including segments 124A and B to lengthen pilot hole 206. Once again, this is achieved in a single continuous stroke as indicated at arrow J in FIG. 21 while operator 204 provides any rotational adjustment to steering head 88 as indicated at arrow K. Most preferably, the distance that drive mechanism 110 drives tube 48 is greater than the length of the pilot tube 124B to be inserted in order to make sufficient room for the coupling thereof subsequent to retraction of pistons 116. The pattern of adding tube segments and continuing to drive pilot tube 48 goes on until the pilot hole is completed or more particularly so that the pilot tube 48 extends out of ground 8 so that sections of pilot tube 48 may be removed as the auger boring operation is underway and thus moves pilot tube 48 gradually forward.

Figure 22:
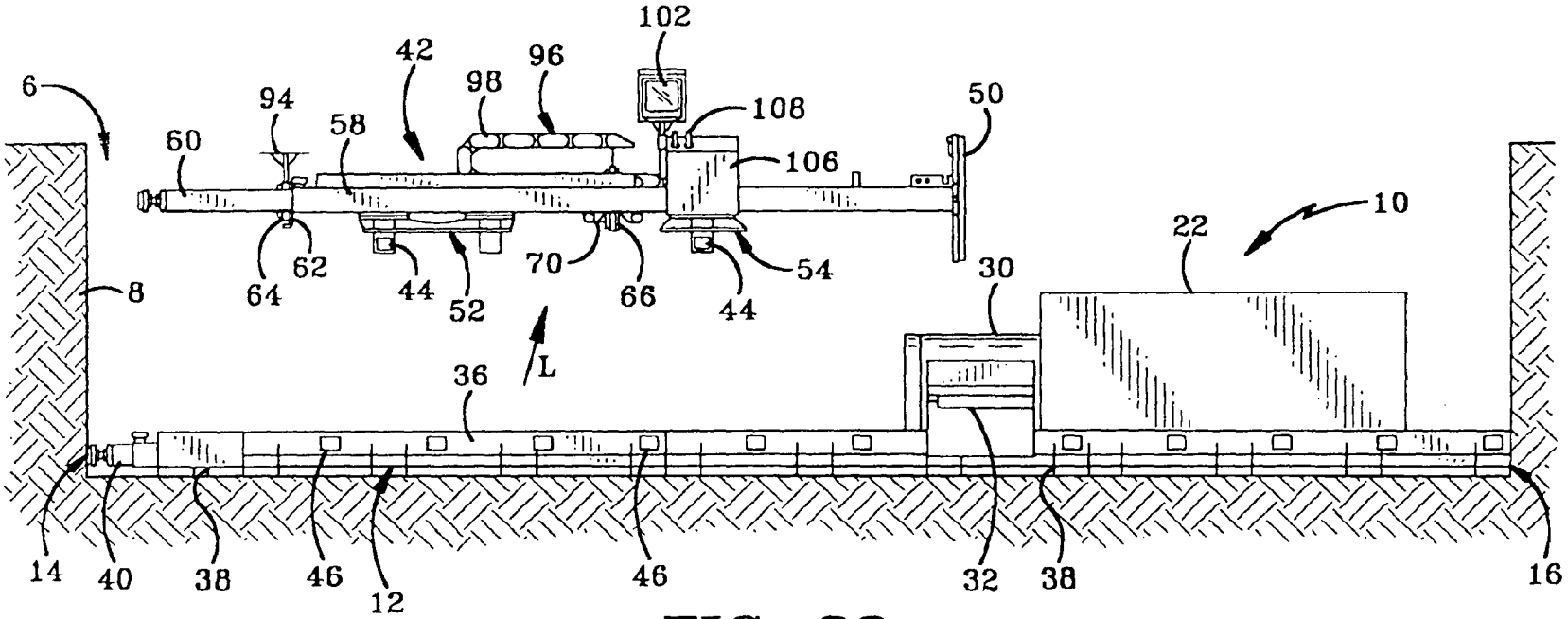
FIG. 22 is a side elevational view of the boring machine showing the pilot tube guidance and drive mechanism being removed from the frame of the auger boring machine.
Figure 23:
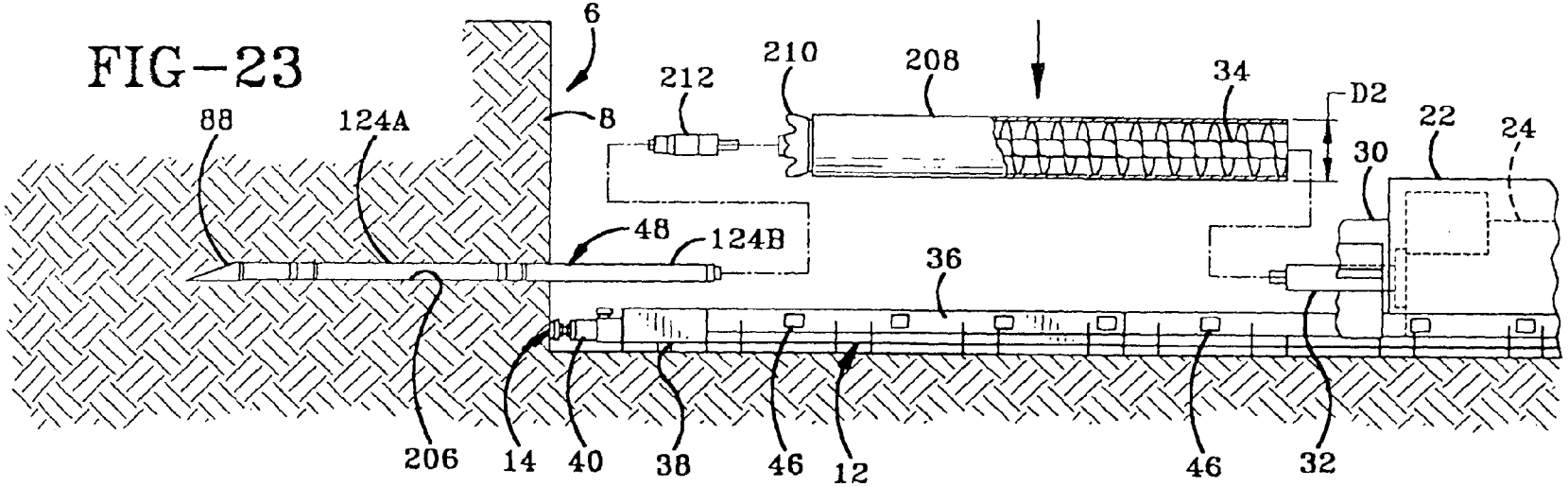
FIG. 23 is similar to FIG. 22 and shows an auger and swivel positioned prior to respective connection to the auger drive and the pilot tube.
Figure 24:
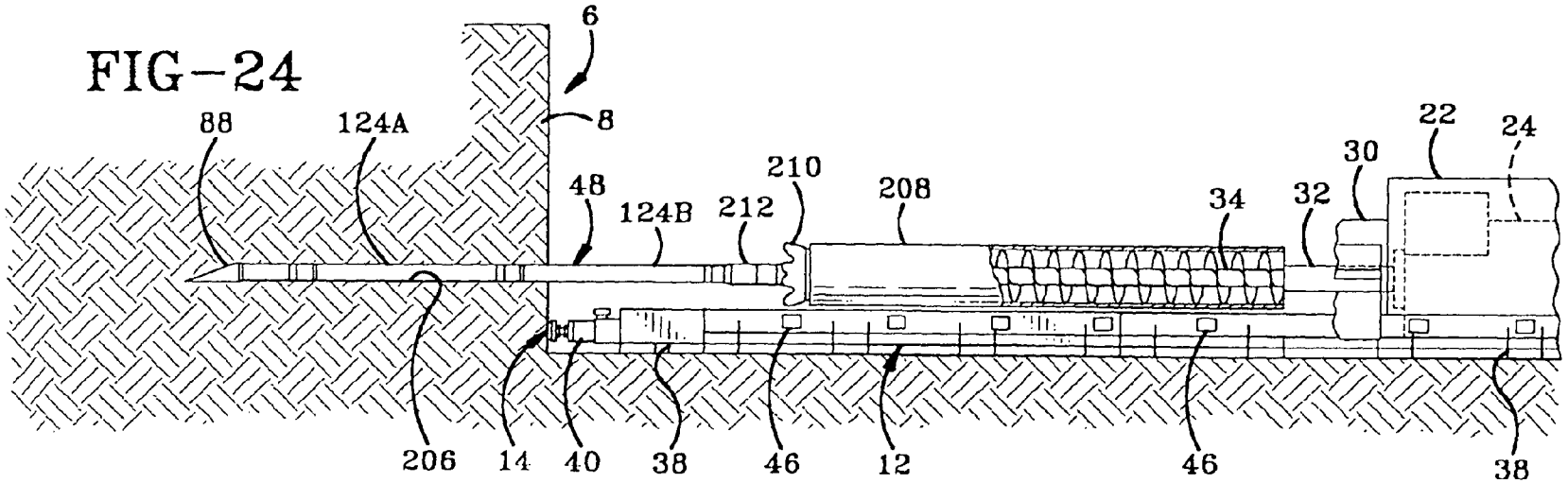
FIG. 24 is similar to FIG. 23 and shows the auger and swivel connected to the auger drive and pilot tube.

Once pilot hole 206 is completed, assembly 42 is removed from frame 12 of auger boring machine 10 as indicated at arrow L in FIG. 22. As shown in FIG. 23, auger 34 is then prepared for connection to output shaft 32 along with the pipe or casing 208 in which auger 34 is disposed and cutting head 210 connected to the front of auger 34 (FIG. 24). A swivel 212 is also connected to the trailing end of pilot tube 48 and the front of cutting head 210 to allow for the rotation of auger 34 and cutting head 210 without rotating pilot tube 48. Swivel 212 is described in greater detail in the copending application Method of Installing Large Diameter Casing and Swivel For Use Therewith which is incorporated herein by referenced and filed concurrently herewith. Cutting head 210 and casing 208 has a diameter D2 which is substantially larger than that of the diameter D1 (FIG. 12) of pilot tube 48. As shown in FIG. 25, engine 24 is then operated to rotate output shaft 32, auger 34 and cutting head 210 (arrow N) as engine 24 moves forward on rails 36 with auger 34 as indicated at arrow P to form a larger diameter hole 214 in which casing 208 will be disposed to form underground piping. Auger 34 carries soil cut by cutting head 210 rearwardly to discharge from its trailing end so that it can be removed from pit 6. Additional casings 208 with augers 34 disposed therein are connected in end to end fashion to increase the length of the pipe to be laid, each casing 208 being welded to the subsequent casing 208. It is noted that engine 24 serves as a single power source for operating auger 34 as well as for powering the drive mechanism of the pilot tube control and guidance assembly via generator 26 and hydraulic pump 28 (FIG. 2), as described in further detail in the copending application entitled Auger Boring Machine With Included Pilot Tube Steering Mechanism which is incorporated herein by referenced and filed concurrently herewith.

Figure 28:
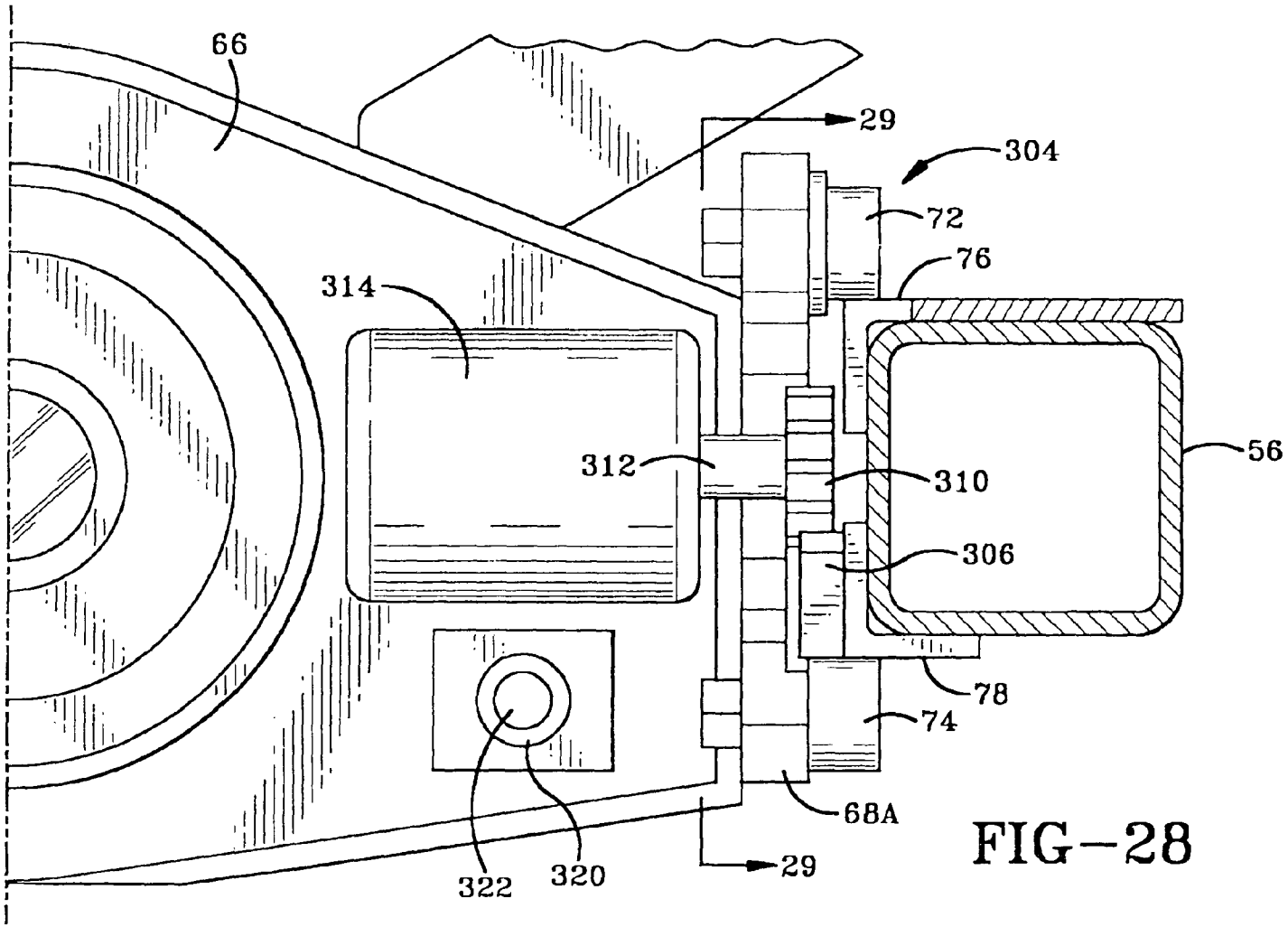
FIG. 28 is a sectional view taken on line 28-28 of FIG. 27.
Figure 29:
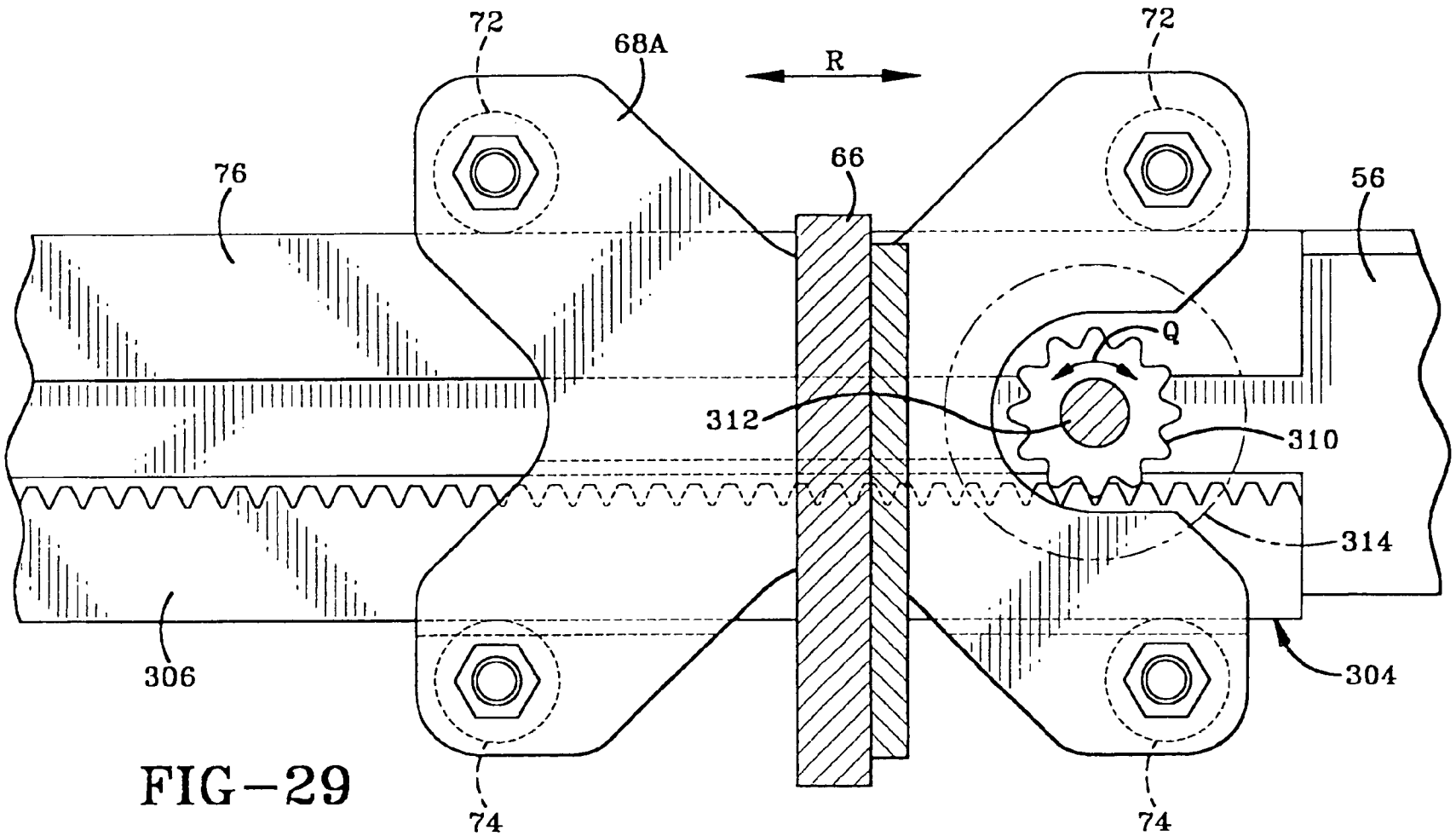
FIG. 29 is a sectional view taken on line 29-29 of FIG. 28.

Auger boring machine 300 is now described with reference to FIGS. 26-29. Machine 300 is similar to machine 10 except that machine 300 includes a pilot tube guidance and drive assembly 302 which differs from assembly 42 of machine 10. More particularly, assembly 302 comprises a rack and pinion drive mechanism 304 which is hydraulically powered by hydraulic pump 28, which is powered by engine 24 as previously noted. Mechanism 304 includes first and second longitudinally extending racks 306 and 308 (FIGS. 27, 30, 31) which are axially spaced from and parallel to one another. Racks 306 and 308 are respectively mounted on rails 56 and 58. As shown in FIG. 26, each of racks 306 and 308 has a longitudinal length L2 which is greater than length L1 of each pilot tube segment 124. Each rack and pinion drive include a pinion 310 only one of which is shown in FIGS. 28 and 29. The gear teeth of pinion 310 engage the gear teeth of rack 306 in a standard fashion. Each pinion 310 is mounted on a rotational output shaft 312 of a hydraulic motor 314 and is rotatable therewith. Hydraulic lines 316 (FIG. 27) communicate with each motor 314 and with hydraulic pump 28 (FIG. 26). Each motor 314 is rigidly mounted on cross member 66 via a respective mounting bracket 318. A pair of bushings or sleeves 320 is rigidly mounted on cross member 66 and slidably mounted on respective guide bars 322 which extend longitudinally parallel to racks 306 and rails 56 and 58. Guide bars 322 are approximately the same length as racks 306 and thus are longer than each pilot tube segment 124. Roller assemblies 68A and 70A are mounted on cross member 66 in the same manner of those of boring machine 10 although with a slight modification to accommodate output shaft 312 as best seen in FIG. 29. Pinions 310 are rotatable as indicated at arrow Q in FIG. 29 in order to drive cross member 66 and the various structures attached thereto including roller assemblies 68 and 70 and pilot tube 48 forward and rearward as indicated at arrow R.

Figure 30:
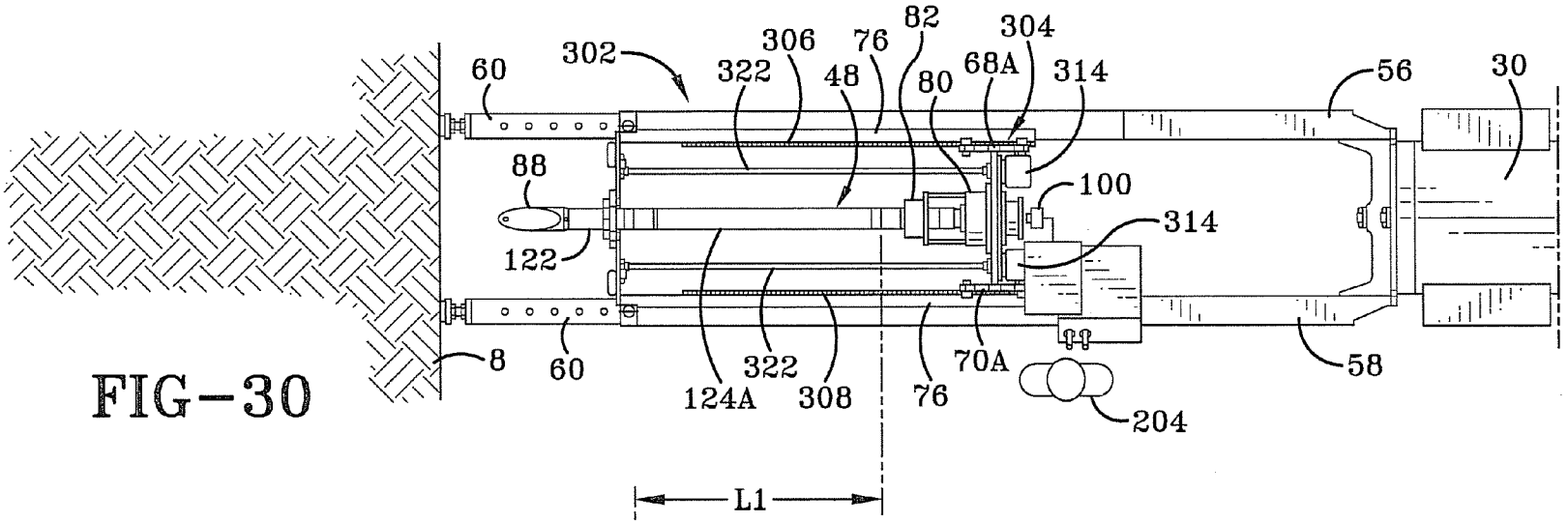
FIG. 30 is a top plan view of the second embodiment showing the pilot tube prior to formation of the pilot hole.
Figure 31:
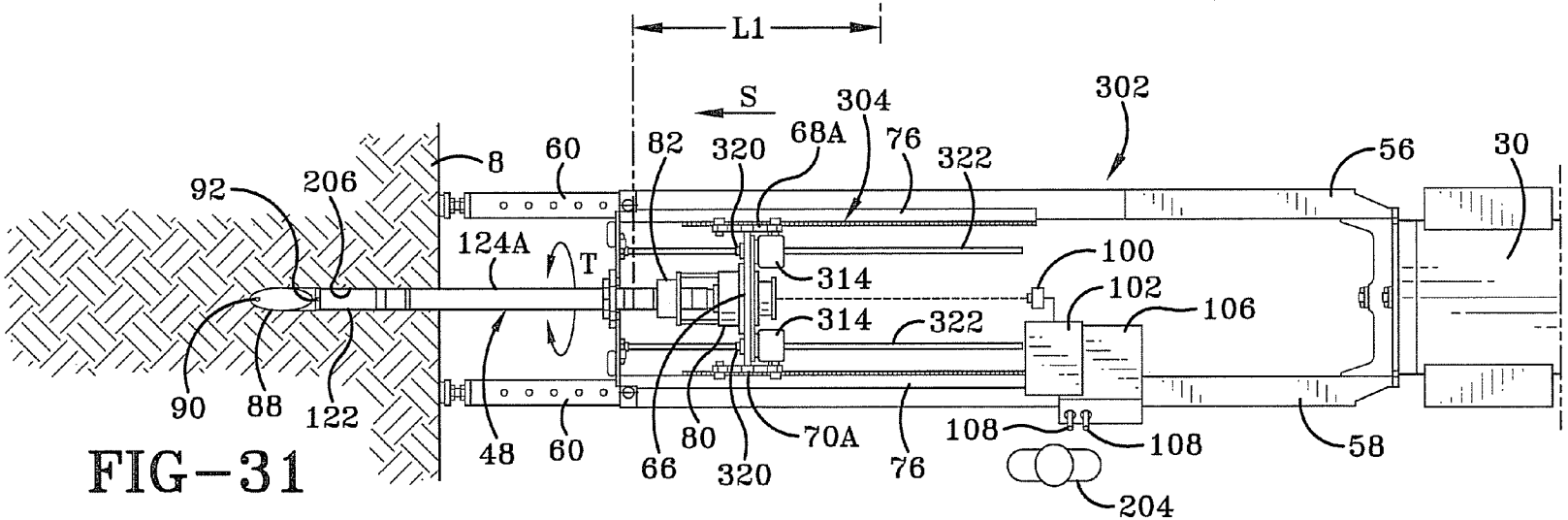
FIG. 31 is similar to FIG. 1 and shows the operation of the rack and pinion drive mechanism driving the pilot tube at an initial stage of pilot hole formation.

Referring to FIGS. 30 and 31, operator 204 thus operates each hydraulic motor 314 to rotate the respective output shaft 312 and pinion 310 so that the teeth thereof drivingly engage the respective teeth of racks 306 and 308 to move pilot tube 48 and the associated mounting structure forward as indicated at arrow S in FIG. 31 from the retracted position of FIG. 30 to the extended position of FIG. 31 to form the initial stages of pilot hole 206. This forward movement may be accomplished in a single continuous stroke as with assembly 42 and involves the movement of roller assemblies 68A and 70A along with pilot tube 48 and all of the associated mounting structures a distance which is greater than length L1 (FIGS. 30-31) of pilot tube segment 124. This movement includes the movement of motor 314 and sleeves 320, which slide along guide bars 322 to help keep cross member 66 and the associated mounted structure aligned during extension and retraction thereof. As with machine 10, operator 204 will also operate motor 80 as needed to rotate pilot tube 48 as indicated at arrow T in order to steer pilot tube 48 via the steering head 88. The lubrication system of assembly 302 is the same as that of assembly 42 and thus water may be pumped through pilot tube 48 through exit openings 90 and 92 of steering head 88 to facilitate formation of pilot hole 206.

FIGS. 32 and 33 show auger boring machine 400, which has a pilot tube guidance and drive assembly 402 with a modified rack and pinion drive mechanism 404. Drive mechanism 404 is the same as drive mechanism 304 except that mechanism 404 includes rack and pinion drives each of which includes a rack 406 which is far longer than each of racks 306 and 308. More particularly, each rack 406 has a length L3 which is roughly twice that of racks 306 and 308 and which is at least twice that of length L1 of pilot tube 124. This extra length allows for sufficient space between lead pilot tube segment 122 and lubricant feed swivel 82 so that two pilot tube segments 124C and 124D may be inserted therebetween and connected thereto at one time while drive mechanism 404 is in the fully retracted position shown in FIG. 32. Hydraulic motors 314 may then be operated to drive the respective pinions 310 along racks 406 to provide a continuous stroke of pilot tube 48 and/or movement over length L3 (FIGS. 32-33) while the frame of assembly 402 remains in a stationary position. Thus, drive assembly 402 allows for the insertion of two pilot tube segments 124 and the movement of pilot tube 48 over a length equal to or greater than two of pilot tube segments 124. Pilot tube segment 124D may then be uncoupled from swivel 82 so that drive mechanism 404 may be retracted to the position of FIG. 32 in order to repeat the process of inserting another pair of pilot tube segments 124 and drive all the segments of the pilot tube again with drive mechanism 404.

A brief comparison between the drive mechanism 404 and drive mechanism 110 of machine 10 shows the advantage of the rack and pinion drive mechanism in taking advantage of the longitudinal length available for a given auger boring machine and pit in which it is disposed. More particularly, while drive assembly 402 has the same overall length as drive assembly 42, the rack and pinion drive mechanism allows for a continuous stroke which is double the length of that provided by assembly 42, which is limited by the length taken up by piston-cylinder combinations 112.

In summary, each of boring machines 10, 300 and 400 provide a pilot tube drive assembly which provides a single continuous stroke over a substantial distance and preferably at least the length of a pilot tube segment. Each of these machines thus solves the problem in the art of moving the frame of a drive mechanism in order to advance the pilot hole.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A drive assembly for use with an auger boring machine pilot tube with at least one pilot tube segment having leading and trailing ends defining therebetween a first length; the drive assembly comprising:

a frame;

a pilot tube engaging member movably mounted on the frame and adapted to drivingly engage the pilot tube;

a drive mechanism for driving the engaging member a first distance equal to or greater than the first length while the frame is stationary;

a lubrication feed swivel comprising first and second portions mounted on one another with relative rotation therebetween; the second portion having leading and trailing ends;

a first coupling member on the leading end of the second portion adapted for mounting on the trailing end of the pilot tube whereby the second portion of the swivel serves as the pilot tube engaging member;

a first lubrication through passage formed in the first portion;

a second lubrication through passage formed in the second portion which communicates with the first through passage and which has an exit opening on the leading end of the second portion whereby the second through passage is adapted to communicate with a third lubrication through passage formed in the pilot tube;

a first line of sight through passage which is formed in the second portion extending from the trailing end of the second portion to the leading end of the second portion, which is separate from the second lubrication through passage, and which is adapted to communicate with a second line of sight passage formed in the pilot tube.

2. The drive assembly of claim 1 wherein the drive mechanism is capable of driving the engaging member the first distance in a single continuous stroke.

3. The drive assembly of claim 1 wherein the drive mechanism comprises a rack and a pinion rotatably engaging the rack.

4. The drive assembly of claim 3 wherein the rack has a length equal to or greater than the first distance.

5. The drive assembly of claim 1 wherein the drive mechanism comprises a hydraulic piston-cylinder combination.

6. The drive assembly of claim 5 wherein the combination comprises a cylinder having a length equal to or greater than the first distance.

7. The drive assembly of claim 1 further comprising a plurality of rollers mounted on the engaging member and rollingly engaging the frame.

8. The drive assembly of claim 1 wherein the first distance is equal to or greater than twice the first length.

9. The drive assembly of claim 1 wherein the first distance is at least three feet.

10. The drive assembly of claim 9 wherein the first distance is at least five feet.

11. The drive assembly of claim 10 wherein the first distance is at least ten feet.

12. The drive assembly of claim 1 further comprising a line and grade steering mechanism adapted to control the line and grade of the pilot tube during the driving thereof.

13. The drive assembly of claim 1 further comprising a mounting mechanism adapted to removably mount the frame of the drive assembly on a frame of the auger boring machine.

14. The drive assembly of claim 13 in combination with the auger boring machine, which comprises a rotatable auger drive adapted to rotate an auger; and further comprising a power source for powering the drive mechanism when the drive assembly is mounted on the boring machine frame and for powering the auger drive when the drive assembly is removed from the boring machine frame.

15. The drive assembly of claim 1 in combination with the pilot tube; and further comprising the third lubrication through passage formed in the pilot tube; the second line of sight passage formed in the pilot tube; and a second coupling member on the trailing end of the pilot tube; an illuminated target within the pilot tube adjacent the leading end of the pilot tube; and wherein the first and second coupling members secure the leading end of the second portion of the swivel to the trailing end of the pilot tube with the second and third lubrication passages in communication with one another, and the first and second line of sight passage in communication with one another so that the illuminated target is visible from the trailing end of the second portion of the swivel through the first and second line of sight passages.

16. The combination of claim 15 further comprising a camera adjacent the trailing end of the second portion of the swivel positioned to view the target through the first and second line of sight passages.

17. A method comprising the steps of:

driving an auger boring machine pilot tube a distance equal to or greater than a length of a first pilot tube segment thereof with a pilot tube engaging member movably mounted on a frame while the frame is stationary to form in the earth a pilot hole adapted to be followed by an auger; wherein the step of driving comprises the step of driving the pilot tube the distance with a lubrication feed swivel which serves as the pilot tube engaging member; and further comprising, during the step of driving, the steps of:

rotating a rotatable portion of the swivel relative to a non-rotatable portion of the swivel to drive rotation of the pilot tube;

sensing from adjacent a trailing end of the rotatable portion of the swivel a target within and adjacent the leading end of the pilot tube through a line of sight passage formed in the rotatable portion of the swivel and pilot tube extending from the trailing end of the rotatable portion of the swivel to the target; and moving water from the swivel into the pilot tube through a lubrication passage formed in the swivel and pilot tube separate from the line of sight passage so that the water exits the pilot tube via an exit opening of the lubrication passage adjacent the leading end of the pilot tube.

18. The method of claim 17 wherein the step of driving comprises the step of driving the pilot tube the distance in a single continuous stroke.

19. A method comprising the steps of:

driving an auger boring machine pilot tube a distance equal to or greater than a length of a first pilot tube segment thereof with a pilot tube engaging member movably mounted on a frame while the frame is stationary to form in the earth a pilot hole adapted to be followed by an auger; wherein the step of driving comprises the step of driving the auger boring machine pilot tube the distance with a lubrication feed swivel which serves as the pilot tube engaging member; and further comprising, during the step of driving, the steps of:

viewing from adjacent a trailing end of the swivel an illuminated target within and adjacent the leading end of the pilot tube through a line of sight passage formed in the swivel and pilot tube extending from the trailing end of the swivel to the illuminated target; and moving water from the swivel into the pilot tube through a lubrication passage formed in the swivel and pilot tube separate from the line of sight passage so that the water exits the pilot tube via an exit opening of the lubrication passage adjacent the leading end of the pilot tube.

20. The method of claim 19 wherein the step of viewing comprises the step of viewing the target with a camera adjacent the trailing end of the swivel.

21. A drive assembly for use with an auger boring machine pilot tube with at least one pilot tube segment having leading and trailing ends defining therebetween a first length; the drive assembly comprising:

a frame;

a pilot tube engaging member movably mounted on the frame and adapted to drivingly engage the pilot tube;

a drive mechanism for driving the engaging member a first distance equal to or greater than the first length while the frame is stationary;

in combination with the pilot tube; wherein the pilot tube has leading and trailing ends; the pilot tube is rotatable about a longitudinal axis extending from the leading end of the pilot tube to the trailing end of the pilot tube; the pilot tube engaging member engages the trailing end of the pilot tube and is rotatable about the axis to drive rotation of the pilot tube about the axis; and further comprising at least one lubrication through passage formed in the pilot tube from adjacent the trailing end of the pilot tube to adjacent the leading end of the pilot tube; and a central line of sight passage formed in the pilot tube from the trailing end of the pilot tube to adjacent the leading end of the pilot tube so that the line of sight passage provides a clear line of sight through the pilot tube from the trailing end of the pilot tube to adjacent the leading end of the pilot tube; wherein the axis is parallel to and within the line of sight passage.

22. A drive assembly for use with an auger boring machine pilot tube with at least one pilot tube segment having leading and trailing ends defining therebetween a first length; the drive assembly comprising:

a frame;

a pilot tube engaging member movably mounted on the frame and adapted to drivingly engage the pilot tube;

a drive mechanism for driving the engaging member a first distance equal to or greater than the first length while the frame is stationary;

in combination with the at least one pilot tube segment, which comprises a first pilot tube segment;

the first pilot tube segment comprises first and second coupling members respectively adjacent the ends thereof adapted for coupling to another pilot tube segment;

the first pilot tube segment comprises a central section having first and second opposed ends;

the first and second coupling members are secured respectively to the first and second ends of the central section;

the central section comprises an outer pipe and an inner pipe within the outer pipe so that the inner and outer pipes define therebetween an annular lubricant passage; and further comprising a central line of sight passage formed through the first coupling member, inner pipe and second coupling member extending from the leading end to the trailing end of the first pilot tube segment;

a lubricant passage formed through the first coupling member in fluid communication with the annular lubricant passage; and a lubricant passage formed through the second coupling member in fluid communication with the annular lubricant passage.

23. The combination of claim 22 further comprising a seal between the inner pipe and first coupling member.

24. A drive assembly for use with an auger boring machine pilot tube with at least one pilot tube segment having leading and trailing ends defining therebetween a first length; the drive assembly comprising:

a frame;

a pilot tube engaging member movably mounted on the frame and adapted to drivingly engage the pilot tube;

a drive mechanism for driving the engaging member a first distance equal to or greater than the first length while the frame is stationary;

in combination with the pilot tube; wherein the pilot tube has leading and trailing ends; and further comprising a central line of sight passage formed in the pilot tube from the trailing end of the pilot tube to adjacent the leading end of the pilot tube;

a motor which is disposed adjacent the trailing end of the pilot tube, which is operatively connected to the pilot tube for driving rotation of the pilot tube and which has leading and trailing ends; and a line of sight passage formed in the motor in communication with the line of sight passage in the pilot tube so that the line of sight passages provide a clear line of sight through the motor and the pilot tube from the trailing end of the motor to adjacent the leading end of the pilot tube.

25. The combination of claim 24 further comprising a first lubricant through passage formed in the engaging member and having an entrance opening adapted to receive lubricant therethrough and an exit opening communicating with a second lubricant through passage formed in the pilot tube segment.

26. The combination of claim 25 further comprising a lubricant feed swivel comprising a first portion defining the entry port and a second portion defining the exit port, rotatably mounted on the first portion and mounted on the pilot tube.

27. The combination of claim 25 further comprising a steering head mounted on the pilot tube segment; and a third lubricant through passage formed in the steering head and communicating with the second passage.

28. The combination of claim 24 further comprising a lubrication feed swivel comprising first and second portions mounted on one another with relative rotation therebetween; the second portion having leading and trailing ends;

a first coupling member on the leading end of the second portion mounted on the trailing end of the pilot tube whereby the second portion of the swivel serves as the pilot tube engaging member;

a first lubrication through passage formed in the first portion;

a second lubrication through passage formed in the second portion which communicates with the first through passage and which has an exit opening on the leading end of the second portion whereby the second through passage communicates with a third lubrication through passage formed in the pilot tube;

a line of sight through passage which is formed in the second portion extending from the trailing end of the second portion to the leading end of the second portion, which is separate from the second lubrication through passage, and which communicates with the line of sight passage formed in the pilot tube.

29. A method comprising the steps of:

driving an auger boring machine pilot tube a distance equal to or greater than a length of a first pilot tube segment thereof with a pilot tube engaging member movably mounted on a frame while the frame is stationary to form in the earth a pilot hole adapted to be followed by an auger;

driving rotation of the pilot tube with a motor; and sensing from adjacent a trailing end of the motor a target within and adjacent the leading end of the pilot tube through a line of sight passage formed in the motor and pilot tube extending from the trailing end of the motor to the target.

* * * * *